US005475999A

United States Patent [19]

Sekiguchi et al.

[11] Patent Number: 5,475,999

[45] Date of Patent: Dec. 19, 1995

[54] DIE-LATERAL EXTRUDING METHOD AND APPARATUS

[75] Inventors: Tsunehisa Sekiguchi; Kenji Iwata, both of Tokyo; Shigeyuki Koide, Kanagawa, all of Japan

[73] Assignees: The Japan Steel Works, Ltd.; Nippon Bulge Industries, Ltd., Tokyo, Japan; Showa Denko K.K., Tokyo, all of Japan

[21] Appl. No.: 150,820

[22] Filed: Nov. 12, 1993

[51] Int. Cl.[6] ..... B21C 23/21

[52] U.S. Cl. ..... 72/259; 72/355.6

[58] Field of Search ..... 72/259, 260, 354.6, 72/354.8, 355.2, 355.6, 358, 359

[56] References Cited

U.S. PATENT DOCUMENTS

| | | | |
|---|---|---|---|
| 3,263,468 | 8/1966 | Rowell . | |
| 3,279,230 | 10/1966 | Johnson | 72/259 |
| 4,104,903 | 8/1978 | Rowell et al. . | |
| 4,604,886 | 8/1986 | McGregor, Jr. | 72/359 |
| 4,662,205 | 5/1987 | Ratte | 72/359 |

FOREIGN PATENT DOCUMENTS

| | | | |
|---|---|---|---|
| 77143 | 4/1987 | Japan | 72/359 |
| 300043 | 10/1992 | Japan | 72/264 |
| 166625 | 7/1921 | United Kingdom | 72/354.6 |

OTHER PUBLICATIONS

Study on Radial Flow Extrusion in Aluminum, Y. Matsuura et al., Imoken Report No. 41, 1985 pp. 49–57.

Study on Extrusion of Large Pipes by Using Smaller Billets, T. Yamada et al., J. of Jn Metal Soc. vol. 46, No. 10, 1982, pp. 1023–1029.

*Primary Examiner*—Lowell A. Larson

*Attorney, Agent, or Firm*—Armstrong, Westerman, Hattori, McLeland & Naughton

[57] ABSTRACT

An axially non-symmetric article is forged by the first upsetting by means of the first and second punches and by the second die-lateral extruding of a metal bar stock which is extruded via an orifice into an extension space(s) which has a greater cross section than the orifice.

22 Claims, 21 Drawing Sheets

DIE-LATERAL EXTRUDING METHOD AND APPARATUS

BACKGROUND OF INVENTION

1. Field of Invention

The present invention relates to a die-lateral extruding method and apparatus.

2. Description of Related Art

Forging of aluminum has various advantages over forging of steel such as scale does not form; furthermore, the forging temperature is low. Forging of aluminum is therefore requested to apply to parts having more complex shape than the steel die-forgings. The producers have recognized such requests.

The history of forging of aluminum has started with the production of aircraft parts where weight reduction was essential. Necessarily precision-forging of parts having complex shape has been achieved by many processes. Many processes have been developed to achieve the precision-forging of parts of complex shape; however, productivity was low. Along with the trend to high demand for aluminum forgings in the automobile industries, cost reduction in such processes has become necessary so that they can replace conventional forging methods.

Since the conventional forging of aluminum has disadvantages of low material yield and productivity, a new plastic working method of aluminum free of such disadvantages must be provided.

Meanwhile, in the production of axially symmetrical forgings, metal bar stock, which may have various shapes, is compression-worked in the axial direction. The metal flow thus formed is virtually ideal and the cavity of the finishing metal die can be filled with the metal. Contrary to this, in the production of forgings having axially non-symmetrical shape, the metal bar stock is subjected to preliminary shaping in multiple steps with rough-forming metal dies. The preliminarily shaped forgings are then subjected to repeated processes to produce the final shape. The metal bar stock is therefore gradually shaped close to the final shape.

The preliminarily shaped article obtained in the production of axially non-symmetrical forgings has the volume, orientation and distribution of material which are appropriate for the subsequent forging to obtain the axially non-symmetrical shape. The hot-forging process for obtaining a preliminarily shaped article is carried out in multisteps. The forging is therefore not completed in a one-heat process.

Particularly in the case of a product having a high axial non-symmetry, not only is the forging process in multisteps, but also a trimming step for removing burrs from the forged material must be inserted between every forging steps; consequently, the material yield and productivity are seriously impaired. In addition, energy consumption for reheating increases. When the multisteps are omitted and the cavity of a metal die is filled with material at an extremely high pressure, internal and external defects such as indentation and cracks are formed, so that defect-free products cannot be obtained.

Meanwhile, the extrusion is used for working the metallic materials. By the extrusion, a high average pressure is applied to a work piece, so that it can be shaped at once into a product having a complicated cross sectional shape. Since the plastic workability property of aluminum is excellent, almost all cross sectional shapes, such as round, rectangular and groove as well as a pipe can be shaped by extrusion of aluminum.

A conventional extrusion method is described with reference to the production of pipe material. Since a billet used for the production of a pipe has a greater diameter than that of the product, the working load and hence the capacity of the working apparatus become high. In addition, since the wall thickness of a pipe is determined by the distance between the inner diameter of a die and the outer diameter of mandrel, the wall thickness locally greatly varies, which is one of the disadvantages of the extrusion method.

In order to overcome the disadvantages of the extrusion method, a Lafro method is proposed (c.f., U.S. Pat. No. 3,263,468 issued to D. W. Rowell, and "Wire Industry" 1976, p 903). In the Lafro method, a metal bar stock is extruded by a plunger, and is subjected to working by a mandrel which converts the flow vector of metal-bar stock into a radial direction. The so worked metal is then subjected to working by a die which again converts its flow vector so as to impart the metal the pipe shape. However, it is only the pipe that can be produced by the Lafro method.

There are reports related to the Lafro method in Study on Radial Flow Extrusion in Aluminum (by Y. Matsuura et al. Imoken Report No. 41, 1985 p49–57) and Study on Extrusion of Large Pipes by Using Smaller Billets (T. Yamada et al., J. of Jn Metal Soc. Vol. 46, No. 10, 1982, p1023–1029).

SUMMARY OF INVENTION

It is an object of the present invention to provide a die-lateral forging method and apparatus for producing an irregularly shaped product having a high axial non-symmetry, in which the preliminary shaping process can be shortened so that the productivity of the entire forging process can be improved.

It is another object of the present invention to provide a die-lateral forging method, in which the shaping load can be reduced, and, further, the internal pressure generated in the cavity during shaping is not so great as in the conventional closed forging, thereby omitting the necessity of clamping the upper and lower dies with an extremely high load.

It is a further object of the present invention to provide a small-sized die-lateral forging apparatus with a low capacity, in which apparatus a clamping mechanism of the upper and lower dies can be small sized due to the lessened shaping load.

It is yet another object of the present invention to provide a die-lateral forging method of aluminum or aluminum alloys, which exhibit excellent hot-flowability, in which the preliminarily shaped article is applicable to produce the highly axial non-symmetric shape of the final product. The material yield is thus enhanced.

It is also another object of the present invention to provide a die-lateral forging method, in which a metal bar stock having a small cross section is upset by extruding the material from a container in the primary shaping and then is caused to flow into the cavity with ideal flow in the secondary shaping.

It is yet another object of the present invention to provide a die-lateral forging method, in which reheating energy can be significantly reduced in the hot working.

It is a further object of the present invention to provide a die-lateral forging method and apparatus for producing a preliminarily shaped article, which is then finally shaped to a high axial non-symmetrical product, in which method and apparatus the extruding pressure during flowing of the material in the cavity is reduced and, further, the preliminary shaping process can be shortened.

One of the die-lateral forging methods according to the present invention comprises preparing a metal bar stock and die-lateral forging the metal bar stock into an irregularly shaped article having a base portion and at least one extended portion extending from said base portion in an axially non-symmetrical pattern, and further comprises:

accommodating said metal bar stock into a container of a die-lateral forging machine, which comprises a first punch having a first contact surface with the metal bar stock, having substantially the same flat-shape as the shape of said base portion of the irregularly shaped article, a first die having an aperture therethrough, a second die having an aperture therethrough, a second punch slidably fitted in the aperture of the second die and having a second contact surface with the metal bar stock, the container for accommodating the metal bar stock, defined by the second contact surface with the metal bar stock and the aperture of the second die, bringing the metal bar stock into contact with the second contact surface of the second punch;

axially aligning the first and second contact surfaces with the metal bar stock in a vertical direction;

defining a cavity by tightly contacting the first die and the second die;

compressing the metal bar stock by the first punch and the second punch and virtually filling the base space mentioned below with the metal bar stock, thereby completing a primary shaping;

said base space is defined by (a) the first contact surface of the metal bar stock at a position where the primary shaping is completed, (b) an inner surface of the first die except for the extension space mentioned below, and (c) the second contact surface of the second punch and a surface of the second die neighboring said second contact surface, the total of these surfaces (c) being substantially same as the first contact surface with the metal bar stock, and the surfaces (a), (b) and (c) forming upper, lateral and lower surfaces of said base space, respectively, coinciding height of the second contact surface with the metal bar stock of the second punch with a contact surface of the second die with the metal bar stock;

carrying out compression by the first punch while keeping said coincidence of height, thereby extruding a portion of the metal bar stock into at least one extension space, which is formed in the first die, has shape and dimension essentially the same as those of said at least one extended portion of the shaped article, is laterally communicated with said base portion via an orifice, and has a cross section greater than the orifice, thereby extruding the metal bar stock and completing a secondary shaping.

In the present inventive method, the metal bar stock is brought into contact with the second contact surface of the second punch with metal bar stock (hereinafter referred to as the "second stock contact-surface") and is accommodated in the container. The first and second dies are brought into tight contact with one another to define the cavity therein. Subsequently, the first punch, first die and second die are displaced integrally relative to the second punch so as to compression-deform the entire metal bar stock. The metal bar stock is first upsetted into the base space of the cavity. The primary shaping is thus completed. Since the primary shaping is upsetting of the entire metal bar stock into the base space as described above, deformation resistance and hence press force are low. This leads to reduction in the press area in the primary shaping. The press area can be approximately the same as the cross-sectional area of the metal bar stock. The press force for upsetting is very small in the primary shaping. The material is filled mainly in the base space and is slightly forced out of the orifice, for example 4 mm at the most.

Subsequently, the compression-deformed metal bar stock is pressed by means of displacing only the first punch so as to obtain a predetermined size. In other words, a portion of the metal bar stock to be laterally extruded to form the extended parts (hereinafter referred to as "the lateral extruding material") is extruded through the orifice(s), and the remaining portion (namely, the other part than the lateral extruding material) of the metal bar stock stays in the base space, so as to shape an irregularly shaped article. During the extrusion, greater press force than the primary shaping is applied on the base portion of a shaped article by means of the first punch which has approximately the same flat-shape as the base portion of the shaped article. The first punch therefore exerts pressure onto one entire side of the base portion of the shaped article. The material flows therefore through the orifice(s) into the extension space(s).

Since the entire surface of one side of the base portion of the shaped article is pressed, the lateral extruding material does not stagnate in the base portion but forms smooth metal flow. In addition, since the cross-sectional area of the extension space(s) is set greater than that of the orifice(s), the restraint force of the material between the first and second dies considerably decreases. The shaping load of the first punch, which is imparted by pressure of a cylinder assembly, can therefore be relatively low.

Through the two-stage shaping process as described above, the metal bar stock is converted into a shaped article free of internal and external defects, such as indentation and cracks. This shaped article may be a preliminarily shaped article, which is subjected to the final shaping by forging. In such article, the metal flow is almost ideal from a viewpoint of subsequent shaping. Material mass distributes irregularly and orients in a non-symmetrical direction by forging. In the subsequent shaping for providing the final shape, the respective portions of the preliminarily shaped article are forged to re-shape the non-symmetrical shape. The subsequent hot-forging step can therefore be completed in a one-heat process. In addition, the quality of the product is improved.

Another inventive method for die-lateral extruding according to the present invention, comprises:

preparing a metal bar stock, which may have various cross-sectional shapes; and, die-lateral extruding the metal bar stock into an irregularly shaped article, said method further comprises:

inserting the metal bar stock, into an aperture of a die-press machine, which comprises a die having an aperture therethrough, a lower die having an aperture therethrough and arranged opposite to the upper die at a predetermined distance, an opposed mandrel having a contact surface with the metal bar stock, said surface being greater than the aperture of the upper die, a punch inserted into the aperture from above the metal bar stock and vertically driven by a first driving device, and, a guide portion for guiding laterally the flow of the metal bar stock being compressed by the punch, formed on the contact surface of the opposed mandrel, compressing between the metal bar stock contact surfaces of the punch and the opposed mandrel, the metal bar stock inserted in the aperture;

during the compressing, flowing the metal bar stock laterally from between the metal bar stock contact surfaces of the upper die and the opposed mandrel, thereby shaping an irregularly shaped article.

According to said another inventive method, the opposed mandrel can be vertically driven during the shaping so as to adjust the distance between the opposed mandrel and the upper die and hence the lateral extrusion thickness. Volume distribution in the lateral direction can be varied and made appropriate for forming an irregularly shaped article.

According to said another inventive method, first, metal bar stock is inserted into the aperture of the upper die, and the punch is lowered by means of the first driving device so as to upset between the punch and the opposed mandrel the metal bar stock inserted into the aperture of upper die. The punch is further lowered to compress the metal bar stock. The metal bar stock is compressed in the space formed between the upper die and the opposed mandrel which has a greater diameter than that of the punch. The metal bar stock is thus extruded laterally from the space and diffuses in the cavity. The metal flow formed by lateral extrusion is excellent.

On the stock-contact surface of the opposed mandrel, guide portions such as grooves and aslant portion(s) are formed to guide the flow of metal bar stock. This flow of metal bar stock separates at selected portions of the metal bar stock and extends in different directions to form an irregular shape. The metal bar stock, which laterally issues out from the stock contact surface of the opposed mandrel, is brought into slight contact with the surface of the upper and lower dies. The metal bar stock therefore freely flows with low friction-resistance.

In this regard, the flat shape of the opposed mandrel, shape of grooves, inclined angle of the aslant portion, and the like can so be adjusted that the flow of metal bar stock arrives virtually at the same time at the respective portions of a preliminarily shaped article having an irregular cross section. As is described above, the flow of stock material leaves the opposed mandrel and advances toward the respective portions of a product. Although this flow is suppressed by the upper and lower dies, their force restraining the flow of metal bar stock is considerably small and hence the flow is free. The press force, which is imparted onto the punch by the first driving device, can therefore be decreased.

Through the two-stage and one-heat shaping process as described above, the metal bar stock is converted into a shaped article free of internal and external defects, such as indentation and cracks. This shaped article may be a preliminarily shaped article, which is subjected to the final shaping. In such article, the metal flow is almost ideal from the viewpoint of subsequent shaping. Material mass distributes irregularly and orients in an axially non-symmetrical direction. In the subsequent shaping for providing the final shape, the respective portions of the preliminarily shaped article are forged to re-shape the non-symmetrical shape. The subsequent hot-forging step can therefore be completed in a one-heat process. In addition, the quality of the product is improved.

The opposed mandrel can be vertically driven by the second driving device. The opposed mandrel can be tightly contacted with the peripheral portion of the upper die and be inserted into the aperture of the lower die which forms a cavity between the same and the upper die.

An inventive die-lateral extruding apparatus for die-forming a metal bar stock into an irregularly shaped article having a base portion and at least one extended portion extending from the base portion in an axially non-symmetrical form, comprises:

a first punch having a first contact surface with the metal bar stock, which surface having essentially the same flat shape with the base portion of the article;

a first driving device for driving the first punch;

a first die having an aperture therethrough;

a second driving device for driving the second punch;

a second die having an aperture therethrough;

a third driving device for driving the second die;

a second punch slidably fitted in the aperture of the second die and having a second contact surface with the metal bar stock;

a container for accommodating the metal bar stock and defined by the second metal-bar-stock contact-surface of the second punch and the aperture of the second die;

a base space defined by (a) the first contact surface of the metal bar stock at a position where the primary shaping is completed, (b) an inner surface of the first die except for the extension space mentioned below, and (c) the second contact surface with the metal bar stock and a surface of the second die neighboring said second contact surface (hereinafter referred to as the second die-neighboring surface), the total of these surfaces (c) being substantially the same as the first contact surface with the metal bar stock, and the surfaces (a), (b) and (c) forming upper, lateral and lower surfaces of said base space, respectively; and, at least one extension space laterally communicated with the base space through an orifice and having a cross section greater than that of the orifice.

In the inventive die-lateral extruding apparatus, the first punch is driven by the first driving device, the first die is driven by the second driving device, and the second die is driven by the third driving device, during the primary shaping. Upon the completion of the primary shaping, the second die is in the lowest position, and the third stock contact-surface around the aperture and the second stock contact-surface of the second punch coincide with one another in height. The upsetting in the primary shaping and lateral extrusion in the secondary shaping can be carried out in the single die forging apparatus.

In an embodiment of the die-lateral extruding method and apparatus according to the present invention, the first die has, at its portion defining the orifice, a downward projection.

The inventive method may comprise, in the primary shaping, stopping the front end of the first punch at an upper periphery of the orifice, or lowering the front end of the first punch below an upper periphery of the orifice, thereby completing the secondary shaping.

According to an embodiment of the die-lateral extruding apparatus of the present invention, the orifice(s) is provided in a movable orifice block having a downward projection, said apparatus further comprises a fourth driving device for driving the orifice block and varying the cross sectional area of the orifice.

Another inventive die-lateral extruding apparatus comprises:

an upper die having an aperture therethrough, for inserting a metal bar stock, which may have various cross-sectional shapes;

a punch inserted into the aperture of the upper die;

a first driving apparatus for vertically driving the punch;

an opposed mandrel having a contact surface with the metal bar stock, said surface being greater than the aperture of the upper die;

a punch inserted into the aperture from above the metal bar stock and vertically driven by a first driving device, and, a guide portion for guiding laterally the flow of the metal bar stock being compressed by the punch, formed on the contact surface of the opposed mandrel.

BRIEF DESCRIPTION OF DRAWINGS

In FIGS. 9 and 10, aslant extended portions of a non-symmetrical article is being shaped by lateral-die extrusion.

DESCRIPTION OF THE PREFERRED EMBODIMENTS

Figure 1:
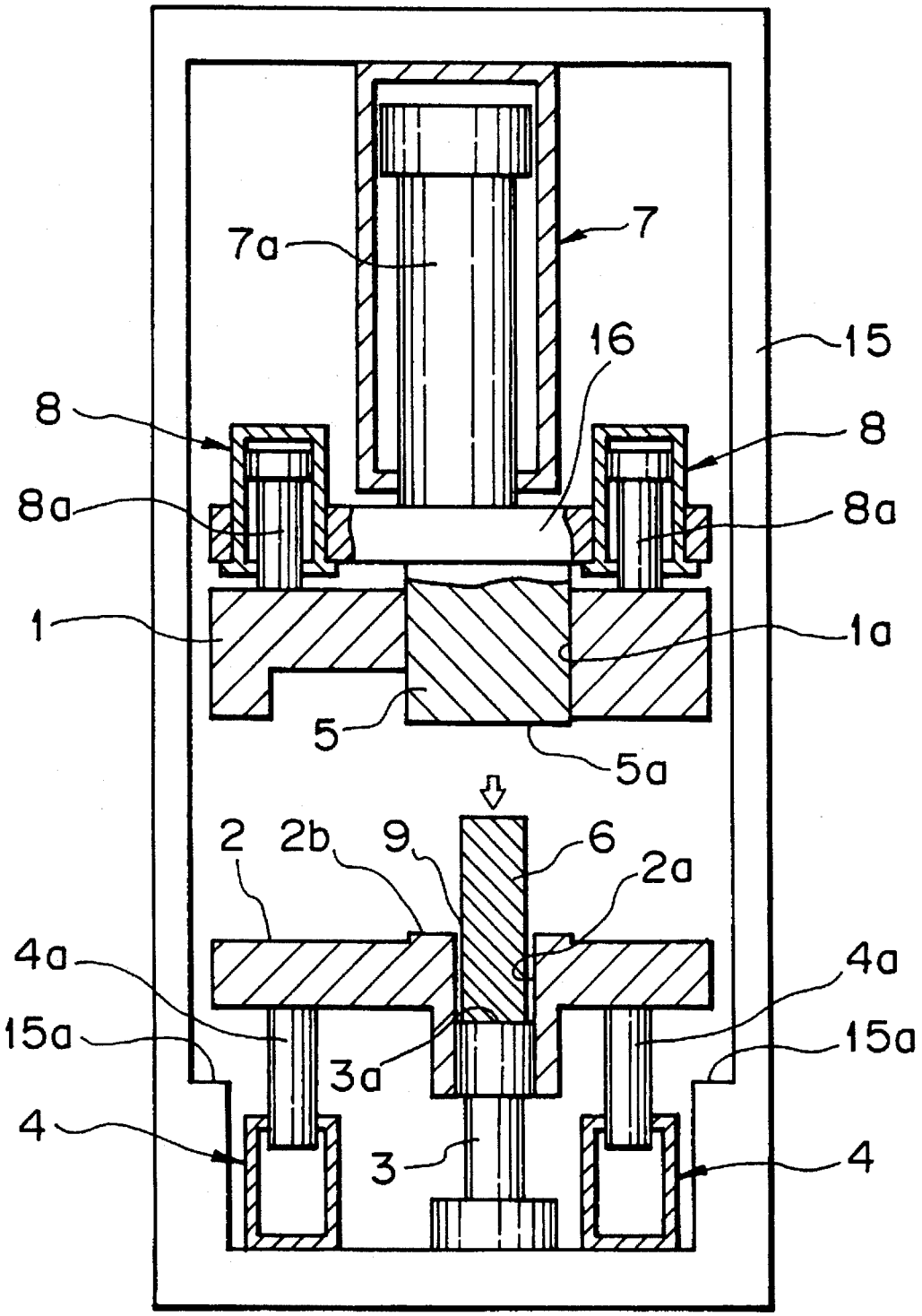
FIG. 1 is a partial cross-sectional view of a die-lateral extruding apparatus for carrying out the first mentioned embodiment.

Referring to FIGS. 1 through 7, a preferred embodiment of the die-lateral extruding apparatus for carrying out the first mentioned inventive method is illustrated. In FIG. 1, a portal frame is shown by the reference number 15. The portal frame 15 is provided, at its upper portion, with a first punch 5 which is vertically driven by the first driving device 7 consisting of a double-action cylinder. The portal frame 15 has, at its bottom portion, a step 15*a*, on which the second die 2 mentioned below engages when it takes the lowest position. The first punch 5 is rigidly secured, via the supporting member 16, to the front end of a piston rod 7*a* of the first driving device 7. The upper double-action cylinder assemblies 8 are rigidly secured to the supporting member 16 in such a manner that their front end protrudes through the supporting member 16. The second driving device consists of the first driving device 7 and the upper cylinder assemblies 8.

Figure 2:
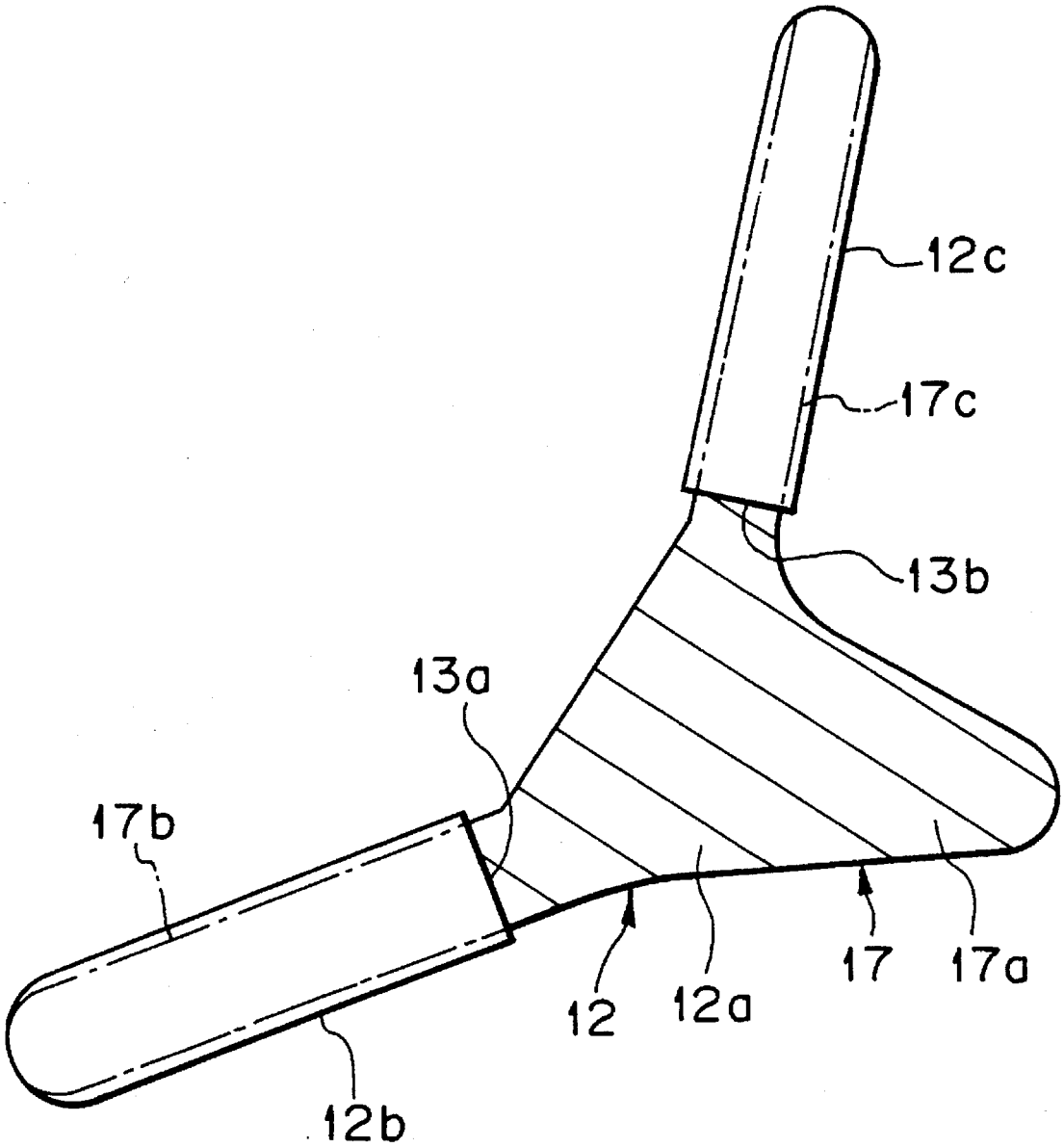
FIG. 2 is an enlarged view of a cavity.
Figure 3:
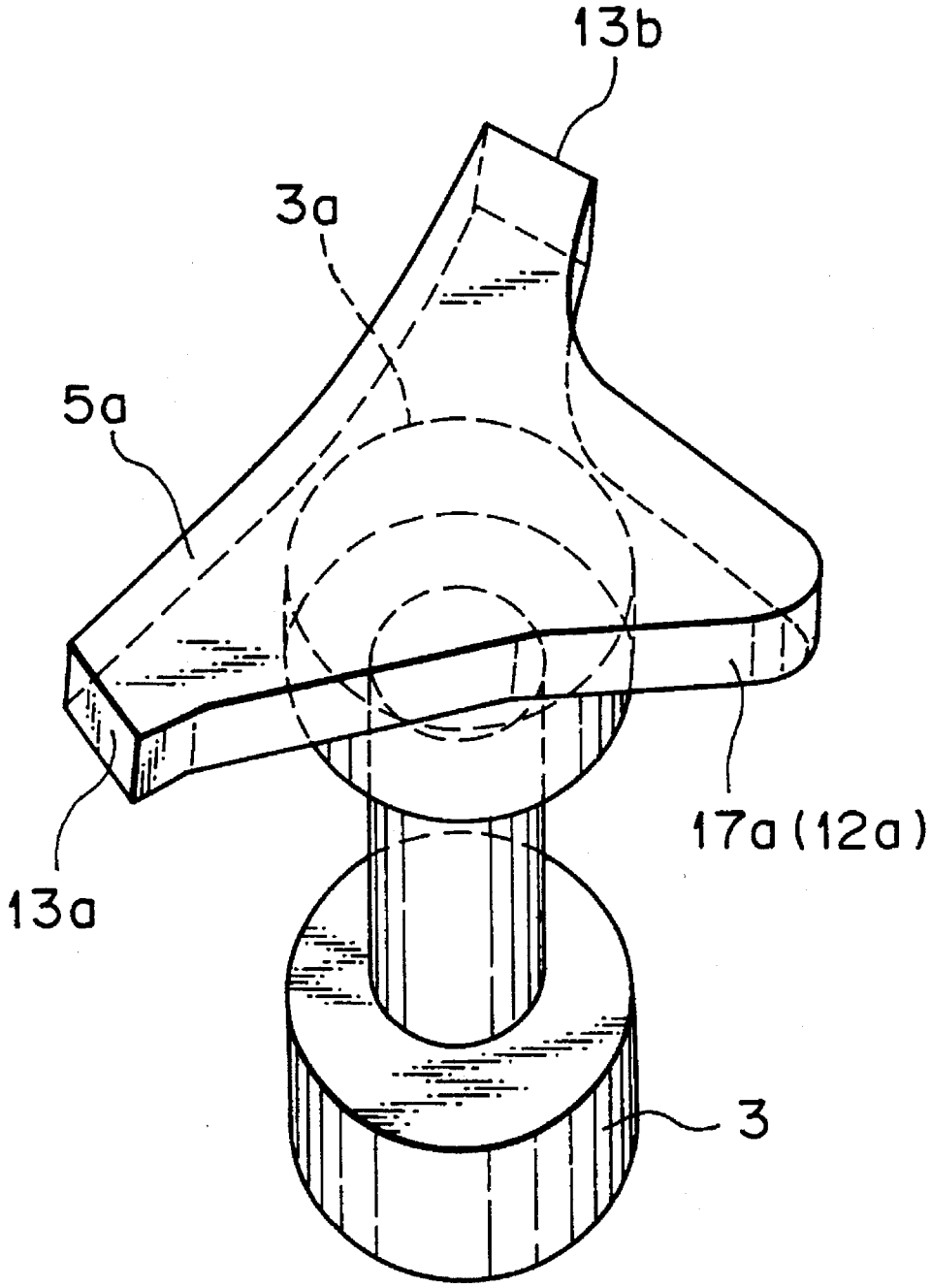
FIG. 3 shows the base portion of a shaped article.

The first die 1 is rigidly secured to the lower end of the piston rod 8*a* of the upper cylinder assemblies 8. The first punch 5 is slidably fitted in the aperture 1*a* of the first die 1. The first punch 5 has the first stock contact-surface 5*a* which defines the cavity 12 mentioned below. The first stock contact-surface 5*a* has a configuration appropriate for shaping the base portion 17*a* of a shaped article 17 (FIG. 2). This shape is, for example, substantially triangular as shown in FIGS. 2 and 3. Any other relatively geometrically simple shape such as square, quadrangle, and bottle guard can be used. The aperture 1*a* of the first die 1 defines the lateral plane of the base space 12*a* (mentioned below) which is a portion of the cavity. The first die 1 has, on its peripheral wall, laterally open portions which form the orifices 13*a*, 13*b*, when the first die 1 is combined with second die 2. The aperture 1*a* of the first die 1 has, therefore, a substantially trianglar shape so that the aperture 1*a* matches the first stock contact-surface 5*a* of the first punch 5. Incidentally, two orifices 13*a*, 13*b* are formed in the present embodiment. One or more orifices may, however, be formed.

The second punch 3 is rigidly secured to the lower portion of the frame 15 and is positioned opposite to the first punch 5. The upper surface of the second punch 3 defines a portion of the base space 12*a* which is also a portion of the cavity 12. This upper surface is the second stock contact-surface 3*a* and is of a smaller area than the first stock contact-surface 5*a* of the first punch 5 and is circular as seen in the plan view, which circle being included in the first stock contact-surface 5*a* (FIG. 3).

The lower cylinder assemblies 4, which are the third driving device, are rigidly secured to frame 15 and are positioned at the circumference of the second punch 3. The second die 2 is attached to the upper end of the piston rods 4*a* of the lower cylinder assemblies 4. The second punch 3 is fitted in the aperture 2*a* of the second die 2, so that they 2, 3 slide relative to one another. A portion of the upper surface of the second die 2, which surrounds the aperture 2*a* of the second die 2, upwards bulges to form the third stock-contact surface 2*b* which defines a portion of the base space 12*a* of the cavity 12. The outer contour of the third stock-contact surface 2*b* coincides, in a plan view, with the first stock-contact surface 5*a* of the first punch 5.

In FIG. 1, the second die 2 is driven upward by the lower cylinder assemblies 4. In such lifted state, the container 9, in which the metal bar stock 6 is accommodated, can be formed by the aperture 2*a* of the second die 2 and above the second stock contact surface 3*a* of the second punch 3. The lower and upper cylinder assemblies 4 and 8, respectively, are equipped with the pressure-adjusting valves (not shown) so as to maintain their inner pressure at a predetermined value.

Figure 4:
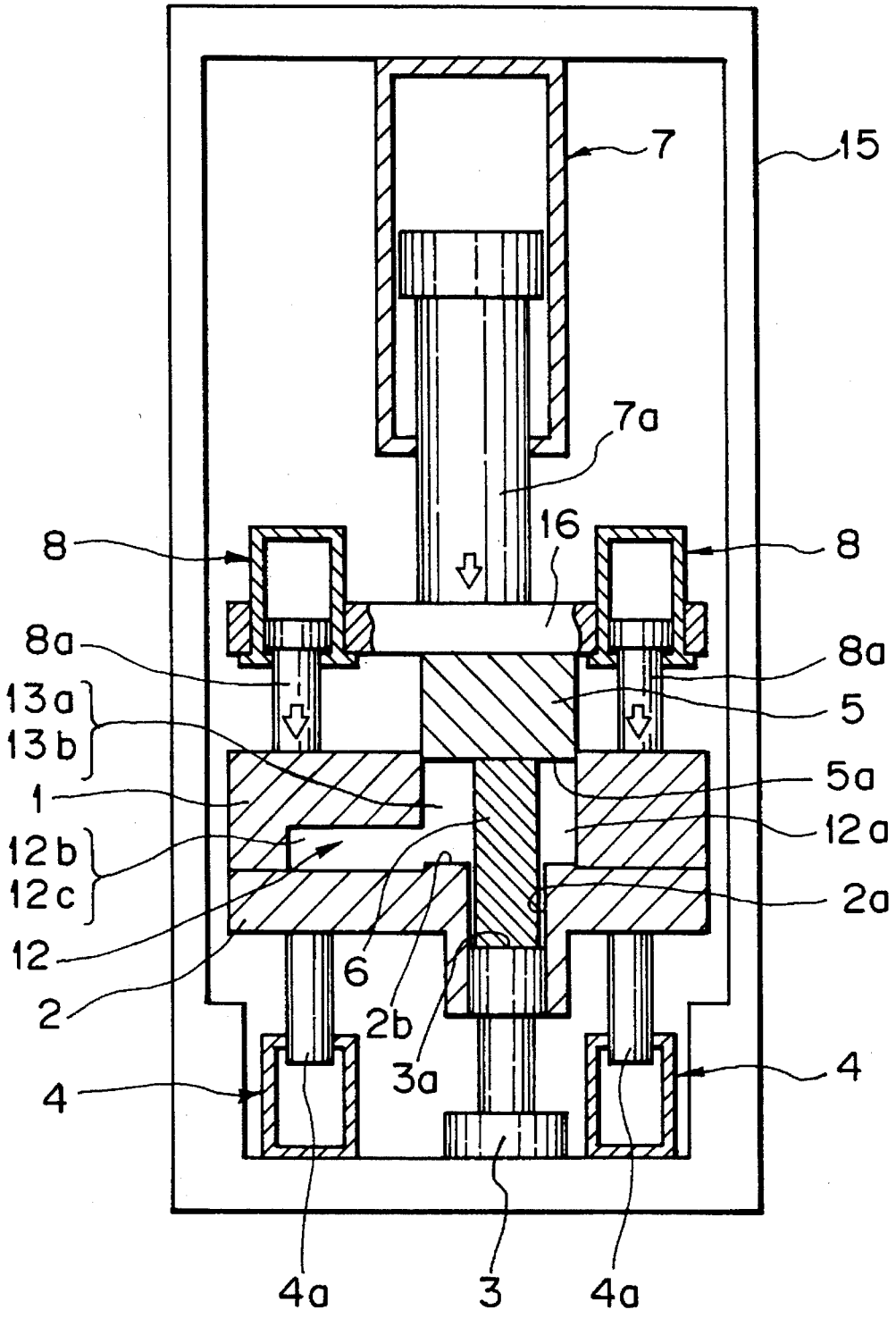
FIGS. 4 through 7 are drawings for showing the operation of the die-lateral extruding apparatus shown in FIG. 1. In this operation, the first mentioned embodiment is carried out to produce a non-symmetrical article having flat extended portions.

Referring to FIG. 4, the first die 1 is downward driven by the first driving device 7 and the upper cylinder assemblies 8, so as to bring the circumferential portion of the first die 1 into tight contact with the second die 2. At this state, the cavity 12 having an irregular cross section other than circle, i.e., an axially non-symmetrical shape, as shown in FIG. 2 is defined. The upper and lower surfaces of the base space 12*a* of the cavity 12 are defined by the first stock-contact surface 5*a* of the first punch 5 and the second stock-contact surfaces 3*a* of the second punch 3 plus the third stock-contact surface 2*b* of the second die 2, respectively. The side of the base space 12*a* is defined by the central inner wall of the first die 1. The extension spaces 12*a*, 12*c* are defined by the first and second dies 1, 2, and extend laterally from the base space 12*a*. The extension spaces 12*a*, 12*c* are therefore communicated with the base space 12*a*. The connections between the former 12*a*, 12*c* and the latter 12*a* are the orifices 13*a*, 13*b*. The base space 12*a* and the extension spaces 12*a*, 12*c* are utilized to form the base portion 17*a* and the extended portions 17*b*, 17*c* of a shaped article 17, respectively.

Under the un-upsetting state as shown in FIG. 1, the orifices 13*a*, 13*b* are defined by the first and second dies 1 and 2, respectively. However, when the first stock-contact surface 5*a* of the first punch 5 is lowered below the inner upper surface of the first die 1 defining the cavity 12, the peripheral portion of the first stock-contact surface 5*a* defines the orifices 13*a*, 13*b* in substitution for the first and second dies 1, 2. The cross-section of the orifices 13*a*, 13*b* thus diminishes. The restraint force of the metal bar stock by the extension spaces 12*a*, 12*c* decreases, because these spaces are spread downward from the third stock-contact surface 2*b* and spreads laterally along the inner wall of the first die 1 as shown in FIG. 2. The pressure imparted to the first punch 5 can therefore be lessened because of low restraint force.

Figure 6:
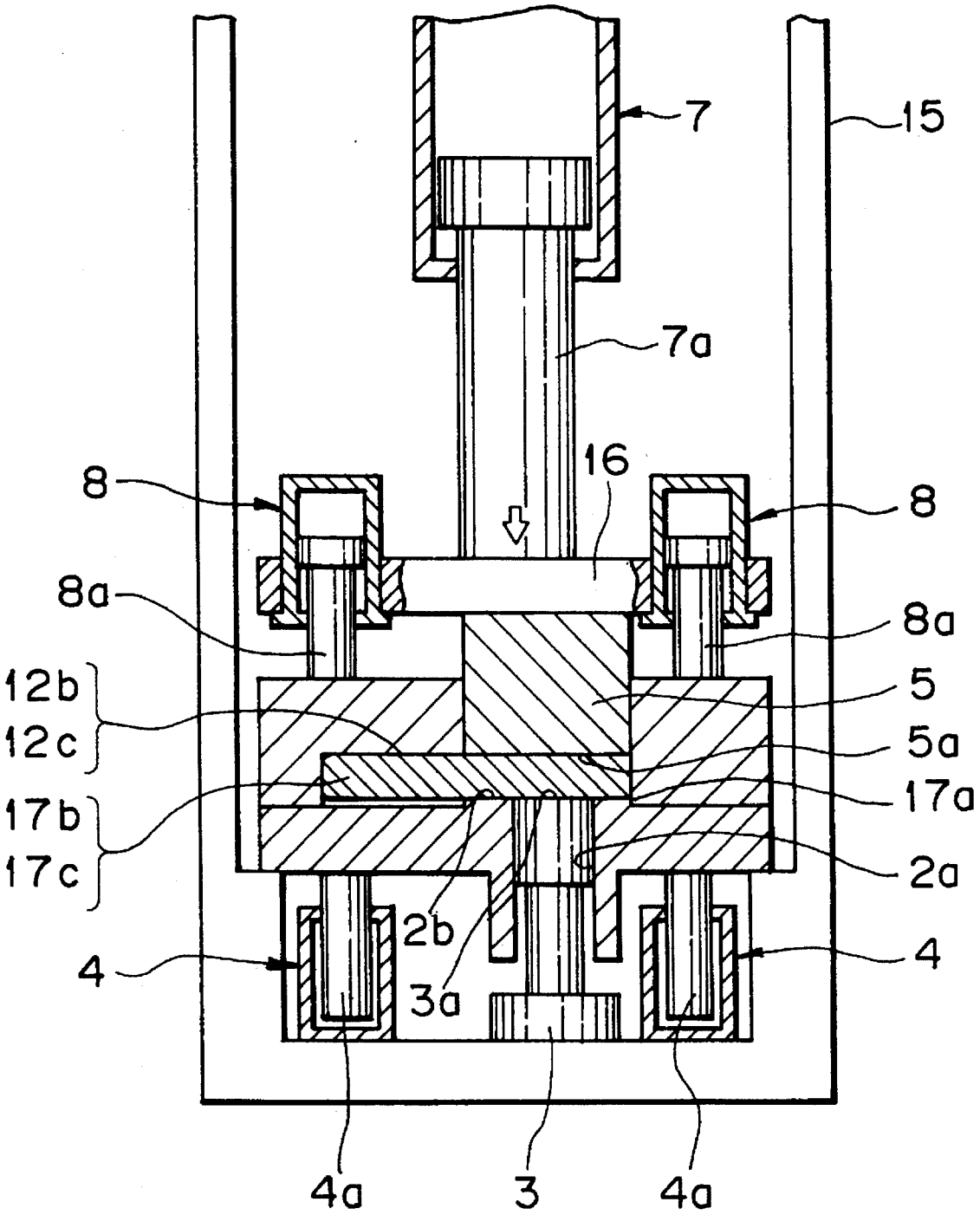

When the metal bar stock is filled in the entire cavity 12 as shown in FIG. 6, a shaped article 17 is formed. The shape of this article substantially coincides with that of the cavity in the plan view, as shown in FIG. 2. The base portion of the shaped article 17 coincides with the base space 12*a* of the cavity. On the other hand, the metal bar stock extends into the extension spaces 12*a*, 12*c* of the cavity 12, while a clearance between the metal bar stock and the cavity is as shown by the imaginary lines. The extended portions 17*b*, 17*c* thus formed are laterally connected with the base portion 17*a*.

The metal bar stock 6 being shaped in FIG. 4 can have various cross-sectional shapes. In the present embodiment, it is circular and corresponds to the second stock-contact surface 3*a* of the second punch 3. The metal bar stock 6 is non-ferrous metal, particularly aluminum and its alloys. When the metal bar stock 6 is carried by the second die 2 on its second stock-contact surface 3*a* and then accommodated in the container 9, then, it can be sandwiched between the first stock-contact surface 5*a* of the first die 5 and the second stock contact surface 3*a* of the second punch 3.

Now, a preferred embodiment of the forging according to the first mentioned inventive method is described with reference to FIGS. 1, 4 through 7.

First, heated metal bar stock is inserted into the container 9 as is shown in FIG. 1.

Referring to FIG. 4, the support member 16 is downward driven by the first driving device 7 so as to lower the first punch 5 and the upper cylinder assemblies 8. At the same time, the upper cylinder assemlies 8 are driven forward so as to impart to the first die 1 a downward displacement relative to the first punch 5. As a result, the first stock-contact surface 5*a* is forced into the first die 1 at a position above the upper defining edges of orifices 13*a*, 13*b*. At this state, the peripheral portion of the first die 1 is brought into tight contact with the second die 2 so as to form the cavity 12. The metal bar stock 6 is sandwiched between the first stock-contact surface 5*a* of the first punch 5 and the second stock-contact surface 3*a* of the second punch 3.

Figure 5:
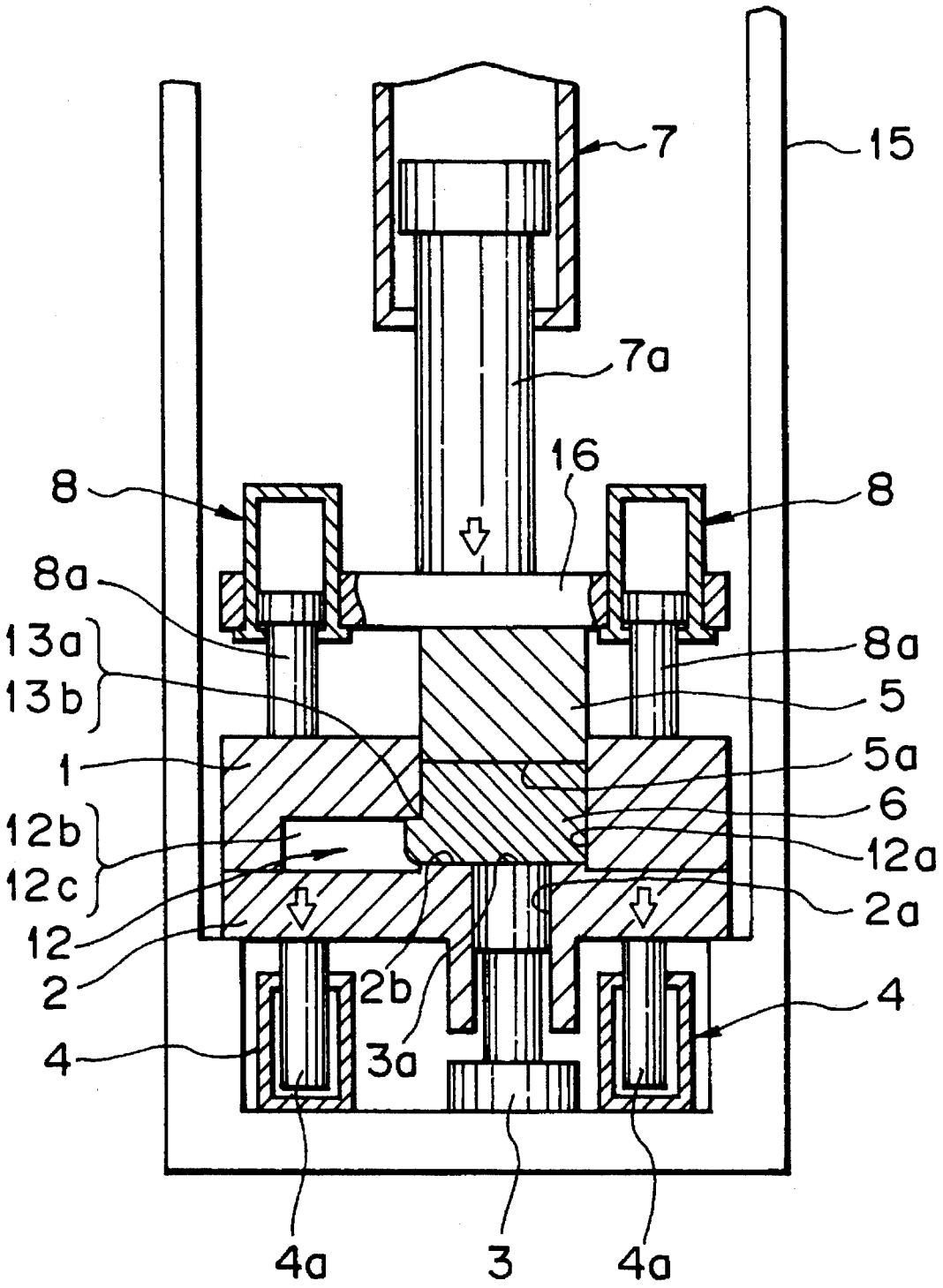

Following the state as described above, the first die 1 and the first punch 5 are downward driven together by the first driving device 7 as is shown in FIG. 4, then, the metal bar stock is subjected to pressure and hence upsetted between the first stock-contact surface 5*a* of the first punch 5 and the second stock-contact surface 3*a* of the second punch 3. Evidently, the lower cylinder assemblies 4 are activated during the upsetting as described, and the pressures of the upper and lower cylinder assemblies 8 and 4, respectively, are set so that the press force of the former is greater than the latter. Subsequently, the metal bar stock 6 as a whole is compression-deformed and upsetted between the first stock-contact surface 5*a* of the first punch 5 and the second stock-contact surface 3*a* of the second punch 3. The metal bar stock 6 is upsetted into and filled in the base space 12*a* of the cavity 12 as is shown in FIG. 5. The original, circular shape of the metal bar stock 6 disappears, and a part of the metal bar stock 6 extrudes somewhat through the orifices 13*a*, 13*b*.

As is shown in FIG. 5, the second stock contact-surface 3*a* of the second punch 3 coincides with the third stock contact-surface 2*b* of the second die 2. At this instance, the second die 2 engages the step 15*a* of the frame 15 and the downward movement of the second die 2 stops. The first driving device 7 is then de-activated so as to terminate the primary shaping. In the primary shaping, the second stock-contact surface 3*a* acts as the pressing area and is relatively small, for example, approximately the same as the cross-sectional area of the metal bar stock 6.

The pressure of upper cylinder assemblies 8 forcing down the first die 1 and the pressure of lower cylinder assemblies 4 supporting the second die 2 are maintained higher than the counter-pressure of metal bar stock 6 which fills the base space 12*a* and forces the dies 1, 2 to open.

Features of the primary shaping according to the present invention are further described. The press force for upsetting can be so low that the orifices 13*a*, 13*b* act as resistance against the lateral flow of metal bar stock. Protrusion of the metal bar stock into the extension spaces 12*a*, 12*c* remains therefore slight, preferably 4 mm at the most. Greater position of the metal bar stock remains thus in the base space 12*a*. When the cross-sectional area of the metal bar stock 6 is greater than that before primary shaping by from 4 to 25 times, the flow of material is well balanced in all portions of the primarily shaped article.

The secondary shaping which is subsequently carried out is now described.

As is shown in FIG. 5, while the coincidence between the second stock contact-surface 3*a* of the second punch 3 and the third stock contact-surface 2*b* of the second die 2 is maintained, only the first punch 5 is lowered lower than the position shown in FIG. 5. For lowering the first punch 5, the first driving device 7 downwardly drives the support member 16 and hence the first punch 5, while the upper cylinder assemblies 8 restrain movement of the first die 1. The first punch 5 therefore lowers along the circumferential wall of the first die 1 which defines base space 12*a* of the cavity 12. The metal bar stock, which has been preliminarily compression-deformed in the primary shaping, is subjected to a further compression-deformation by the first punch 5. The compression is imparted through the first stock contact-surface 5*a* of the first punch 5. The lateral extruding material is entirely laterally extruded through the orifices 13*a*, 13*b* into the extension spaces 12*a*, 12*c* of the cavity 12, thereby shaping an irregularly shaped article 17, as is shown in FIG. 2. The total upsetting ratio of primary and secondary shaping is preferably from 20% to 75%.

The metal bar stock 6 is compression-deformed by the first stock contact-surface 5*a* having a relatively greater press-area than the second stock contact-surface 3*a*. The extension-spaces 12*a*, 12*c* of the cavity 12 are filled with the metal bar stock 6 substantially up to their front ends.

In the above described embodiment of the first mentioned inventive method, the orifices 13*a*, 13*b* are flat and the first punch 5 does not reduce the cross-sectional area of the orifices 13*a*, 13*b*. The shaped article 17 has therefore an identical thickness at the base portion 17*a* and extension portions 17*b*, 17*c*.

As is described above, the primary shaping is the vertical upsetting of the metal bar stock 6 as a whole from above and below. The secondary shaping is: exerting pressure onto one of the surfaces of the base portion 17*a* of a shaped article 17 (FIG. 2); and, the one surface is entirely subjected to pressure. During the secondary shaping, the second stock contact-surface 3*a* and the third stock contact-surface 2*b* forms a plane (FIGS. 5 and 6). Only the lateral extrusion is carried out. Therefore, the laterally extruding material does not stagnate in the base space 12*a*, and formation of dead metal is prevented. The obtained shaped article 17 (FIG. 2) is free of internal defects and has improved metal flow. In addition, since the extension spaces 12*a*, 12*c* have an enlarged cross section relative to the orifices 13*a*, 13*b* (FIG. 5 and 6), preferably from 3 to 15 times, the metal bar stock 6 laterally extruded lightly touches the first and second dies 1 and 2, respectively, to such an extent that deflection and sagging down of the material are prevented. Friction resistance is so lessened that the metal bar stock freely flows. The flow of metal bar stock, which is directed via the orifices 13*a*, 13*b* toward all sides of the extension spaces 12*a*, 12*c* of the cavity 12, is therefore free. The constraining force of the metal bar stock 6 between the first and second dies 1 and 2, respectively, is therefore very small. The press force of the first driving device 7, which is imparted to the first punch 5, can therefore be relatively small.

Figure 7:
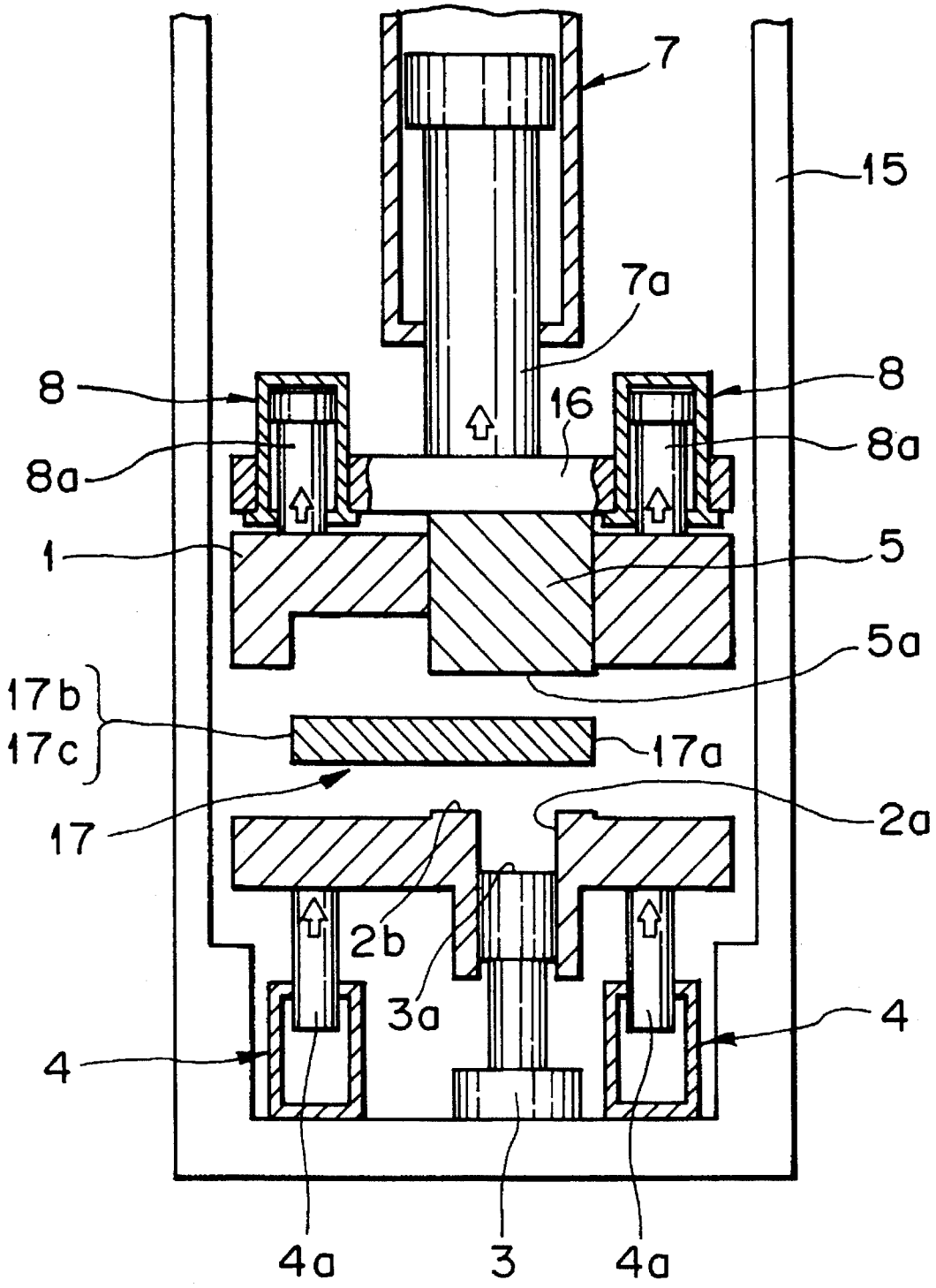

Referring to FIG. 7, the first driving device 7 and the upper cylinder assemblies 8 are reverse driven to revert the first die 1 and the first punch 5 to the original position. The lower cylinder assemblies 4 are forward driven to relieve the tight contact between the second stock contact-surface 3*a* of the second punch 3 and the shaped article 17, thereby allowing it to withdraw outside the dies.

Figure 8:
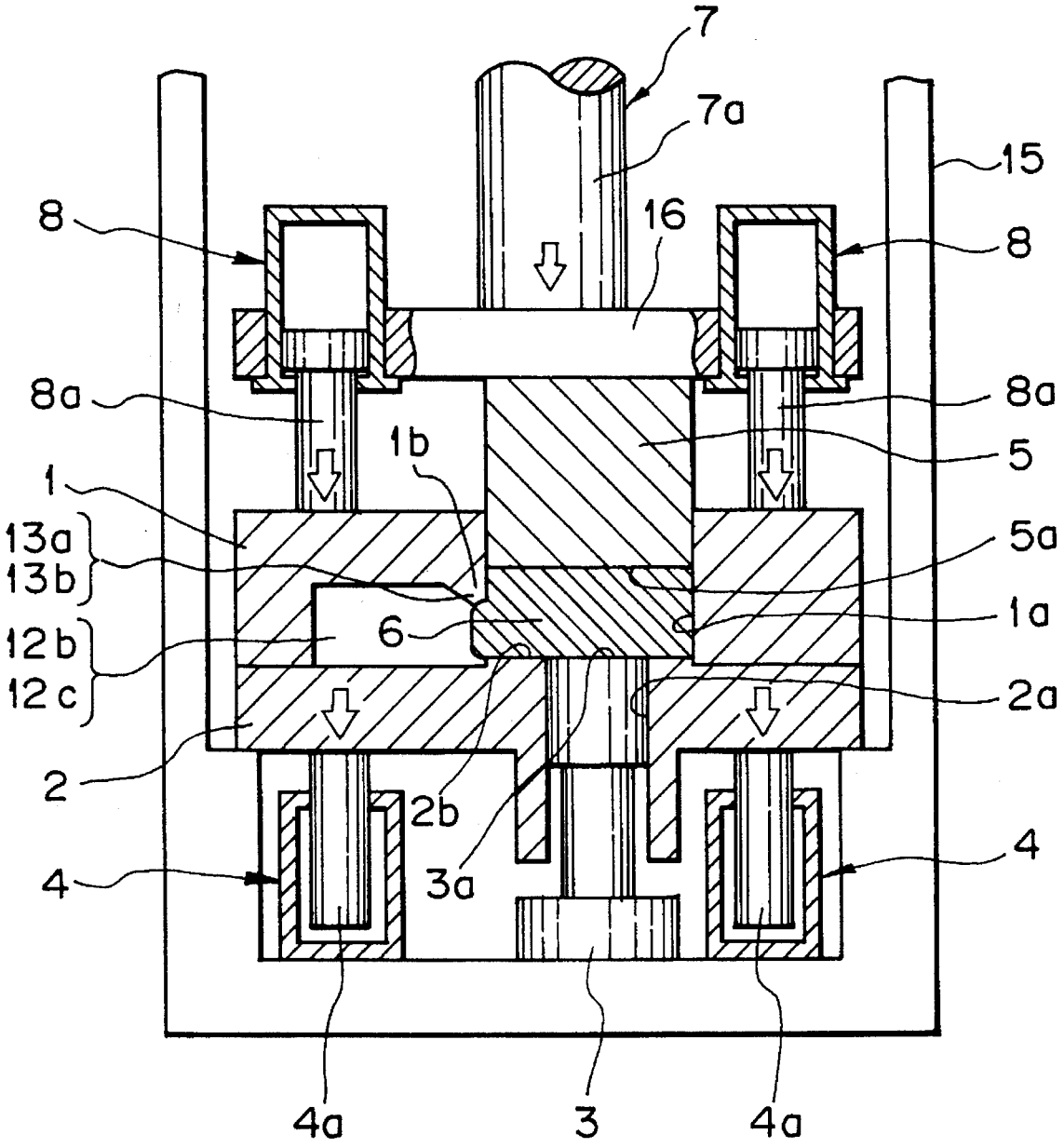
FIGS. 8 through 10 are partial cross-sectional views of a die-lateral extruding apparatus for carrying out the second mentioned embodiment of the method according to the present invention.
Figure 9:
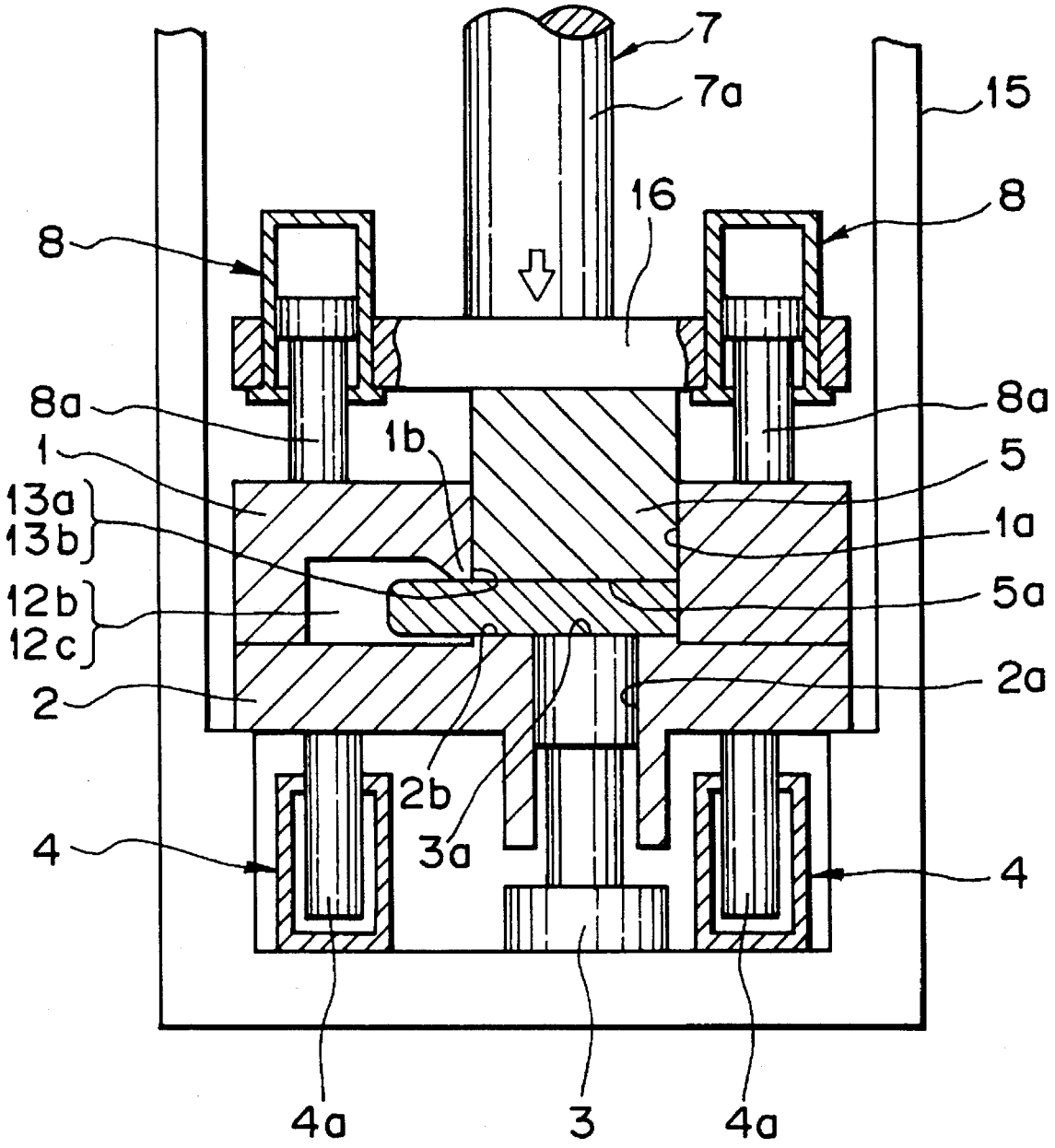
Figure 10:
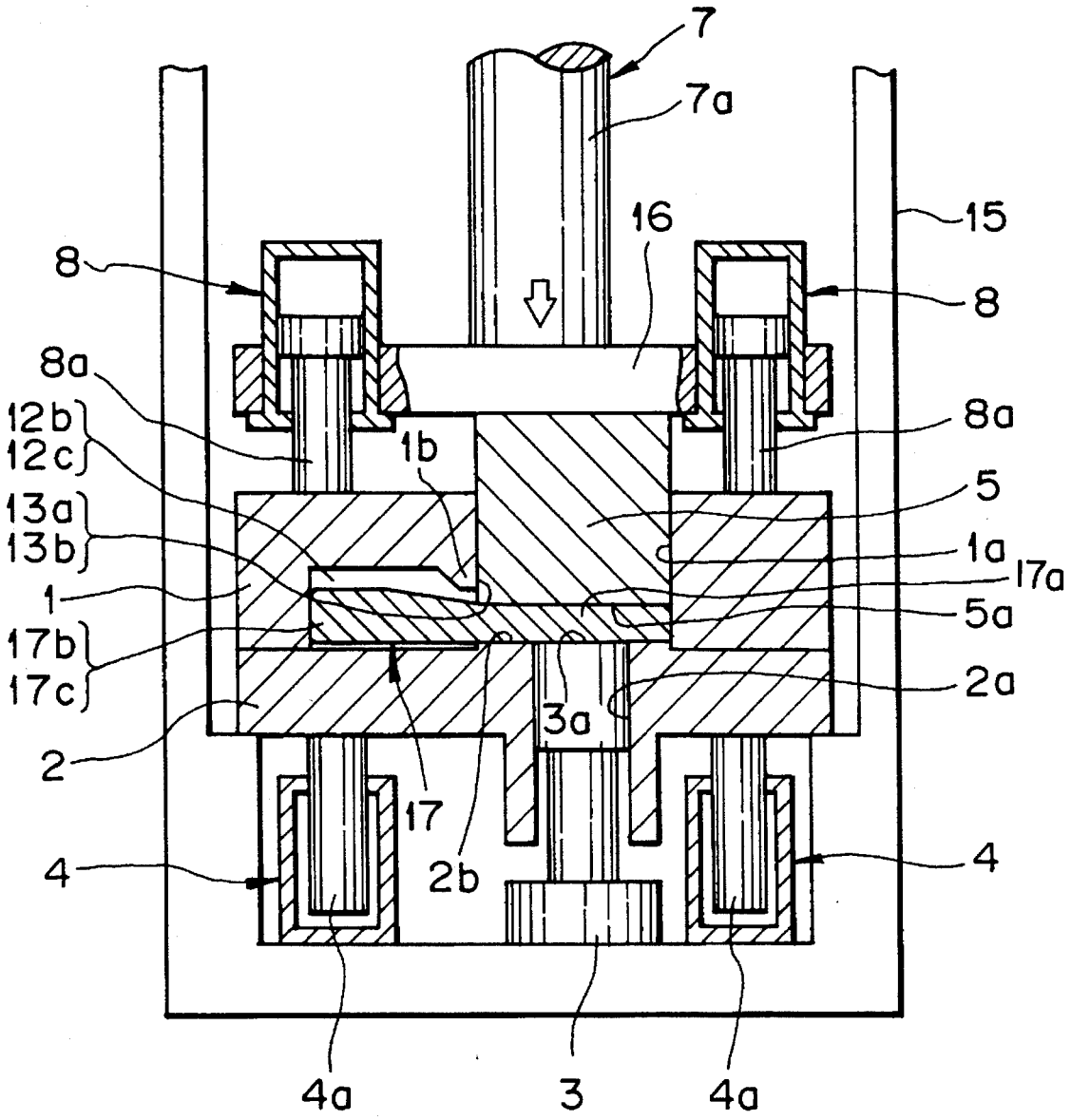

Referring to FIGS. 8 through 10, the second mentioned embodiments of are described. The same parts of the apparatus as those shown in FIGS. 1 through 7 are denoted by the same reference numbers. In the die-lateral extruding apparatus shown in FIGS. 8 through 10, the orifices 13*a*, 13*b* of the first die 1 are provided with the projection lb which contracts a cross section of the orifices 13*a*, 13*b*.

Similarly to the method described with reference to FIGS. 1 through 7, the primary shaping is completed as shown in FIG. 8. Subsequently, as is shown in FIG. 9, only the first punch 5 is displaced to such a position that the first stock contact-surface 5*a* of the first punch 5 and the projection 1*b* of the first die 1 coincide with one another. During this displacement, the metal bar stock is laterally extruded via the contracted orifices 13*a*, 13*b* while maintaining the uniform thickness. Only the first punch 5 is further displaced to the position below the projection 1*b*, then, the metal bar stock 6 is pressed between the first stock contact-surface 5*a* of the first punch 5 and the second stock contact-surface 3*a* of the second punch 3 plus the third stock contact-surface 2*b* of the second die 2 and is laterally extruded.

The metal bar stock, which has been laterally extruded away from the projection 1*b*, is relieved from the restraint force by the projection 1*b*. Extrusion of the lateral extruding material occurs therefore under the restraint free condition. When the first stock contact-surface 5*a* of the first punch 5 is lowered below the upper edge of the orifices 13*a*, 13*b*, the thickness of the laterally extruding material decreases. This decrease corresponds to the lowering amount of the first punch 5. The metal bar stock 6 is thus laterally extruded in a horizontal direction and fills the extension spaces 12*a*, 12*c* virtually up to their front ends. An irregularly shaped article 17 is thus shaped. Upon the completion of the secondary shaping, the shaped article 17 is withdrawn out of the dies as in the method described with reference to FIG. 7.

The extended portions 17*b*, 17*c* of a shaped article 17 have, as seen in a side view reference to FIG. 10, a flat shape at its front portions and are an inclined surface between the front portions and the base portion 17*a*. The thickness of the inclined portion decreases toward the base portion 17*a*. The upper edges, which define a portion of the orifices 13*a*, 13*b*, are the projection 1*b* of the first die 1 during the primary shaping and the peripheral edge of the first punch 5 during the secondary shaping. The extension spaces 12*a*, 12*c* are enlarged in cross section relative to the orifices 13*a*, 13*b* in upward, downward, right and left directions. The method described with reference to FIGS. 8 through 10 attains therefore merits as described for FIGS. 5 and 6.

Figure 11:
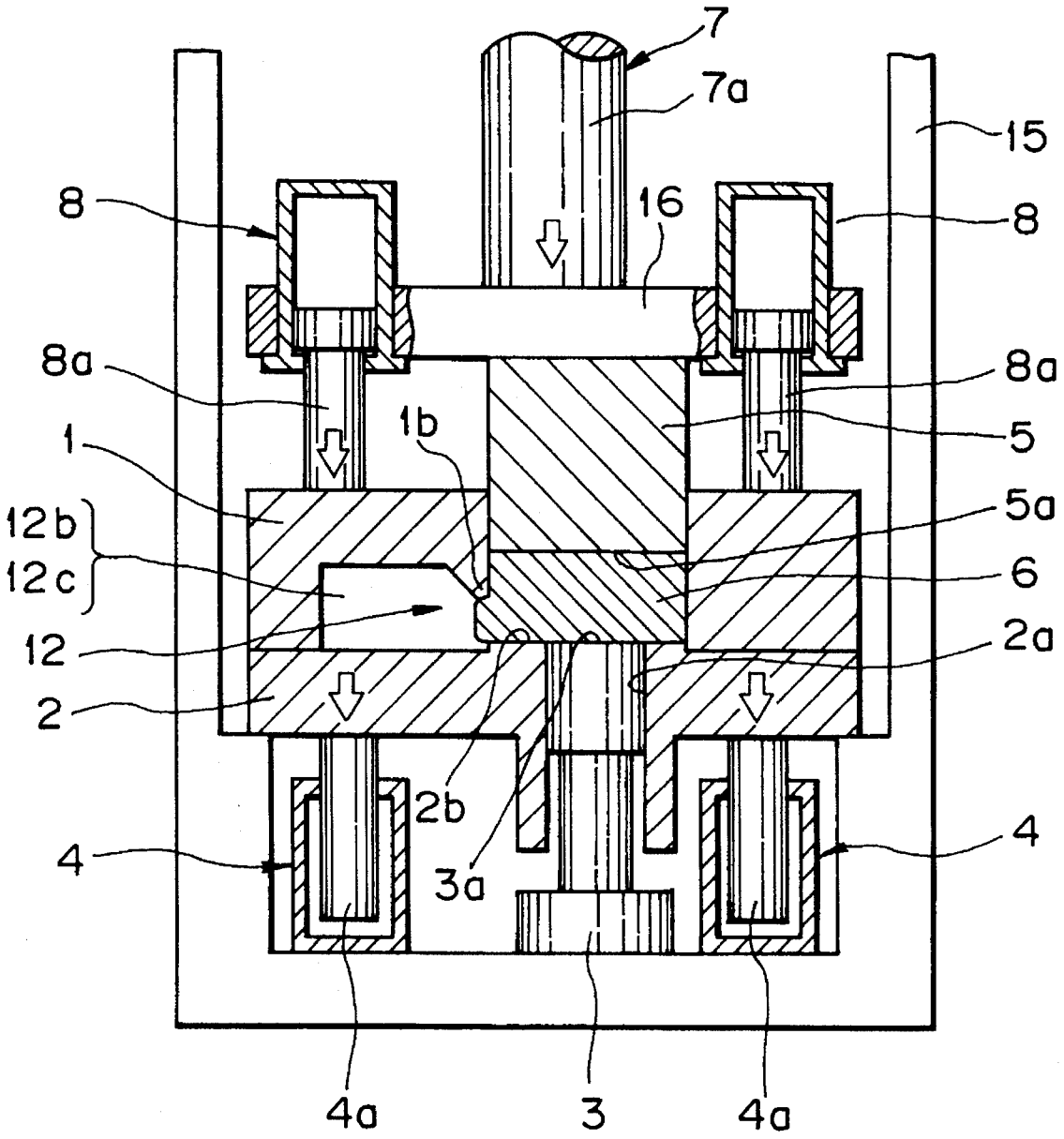
FIGS. 11 and 12 are partial cross-sectional views of a die-lateral extruding apparatus for carrying out the third embodiment of the present invention.
Figure 12:
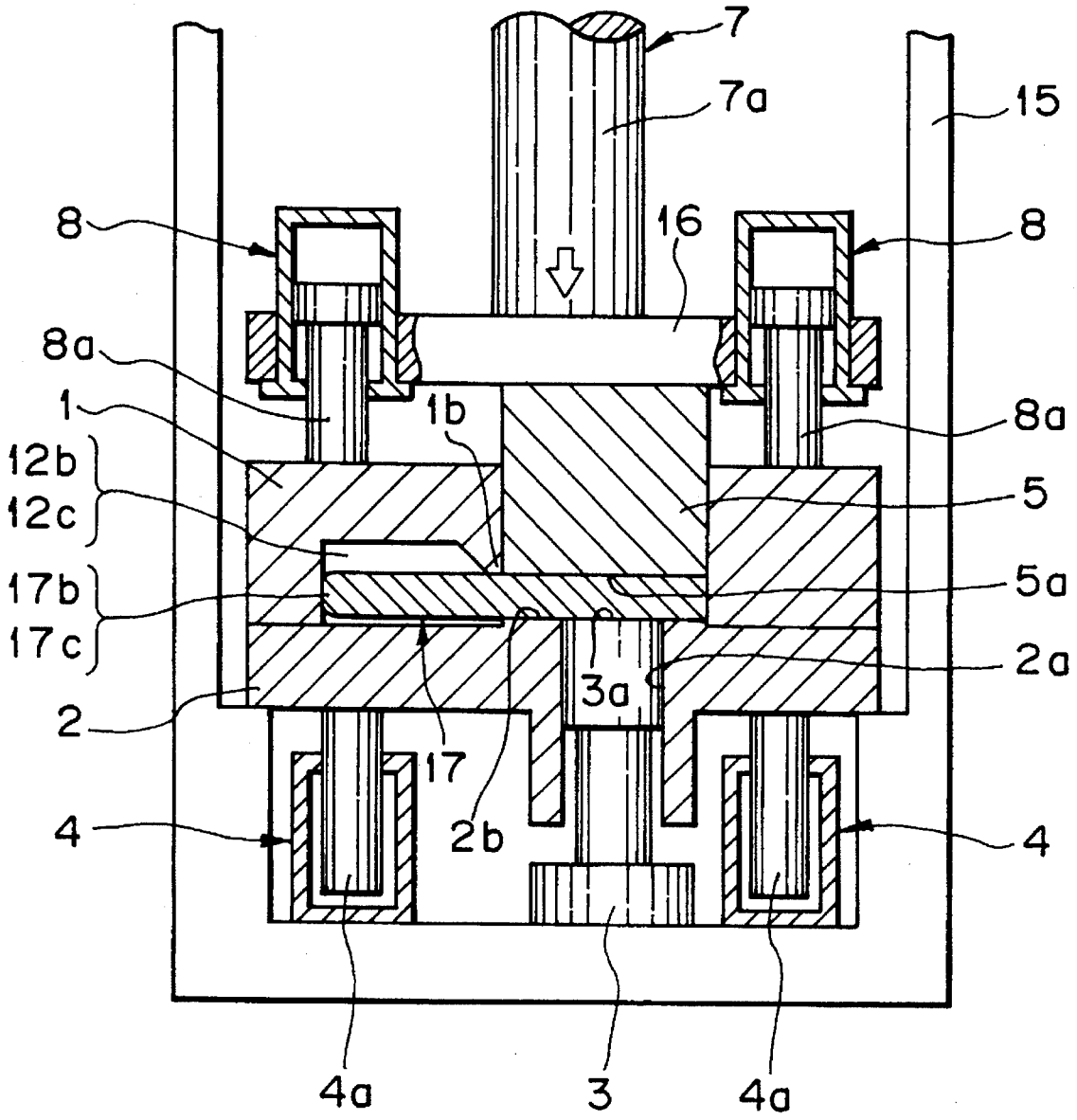

Referring to FIGS. 11 and 12, the third embodiment is illustrated. The same parts of the apparatus as those shown in FIG. 8 are denoted by the same reference numbers. The method illustrated in FIGS. 11 and 12 is different from the method illustrated in FIGS. 8 through 10 only in the relative position of the first die 1 and the first punch 5 at completion of shaping.

The completion of the primary shaping is illustrated in FIG. 11. In this state, the second stock contact-surface 3*a* of the second punch 3 coincides with the third stock contact-surface 2*b* of the die 2, so that the second stock contact-surface 3*a* forms a part of the die cavity, as in the case of the above described embodiments. In addition, the first punch 5 is inserted into the first die 1 and the first stock contact-surface 5*a* is positioned sufficiently above the projection 1*b* of the first die 1 as in the cases of the above described embodiments. The original, circular cross-sectional shape of the metal bar stock disappears, and a part of the metal bar stock extrudes somewhat through the orifices 13*a*, 13*b* as in the cases of the above described embodiments.

Subsequently, as is shown in FIG. 12, only the first punch 5 is displaced to such a position that the first stock contact-surface 5*a* of the first punch 5 and the projection 1*b* of the first die 1 coincide with one another. During this displacement, the lateral extruding material is laterally extruded via the orifices 13*a*, 13*b*, whose upper edges are contracted by the projection 1*b*, while maintaining uniform thickness. The first punch 5 is further displaced. When the first stock contact-surface 5*a* coincides with the projection 1*b* of the first die 1, the extension spaces 12*a*, 12*c* of the cavity 12 are substantially filled with the lateral extruding material so as to shape an irregularly shaped article 17. Upon completion of the secondary shaping, the article 17 is withdrawn from the die-lateral extruding apparatus by the same method as described above.

The surface of the base portion 17*a* and extended portions 17*b*, 17*c* of the shaped article 17 is, as seen in the side view reference to FIG. 12, continuously flat. In addition, the construction of the orifices 13*a*, 13*b*, the projection 1*b* of the first die 1 and the extension spaces 12*a*, 12*c* of the cavity 12 prevent the laterally extruding material from being constrained by the first die 1, as is described with reference to the above embodiments. In addition, the press force of the first driving device 7 can be small.

Figure 13:
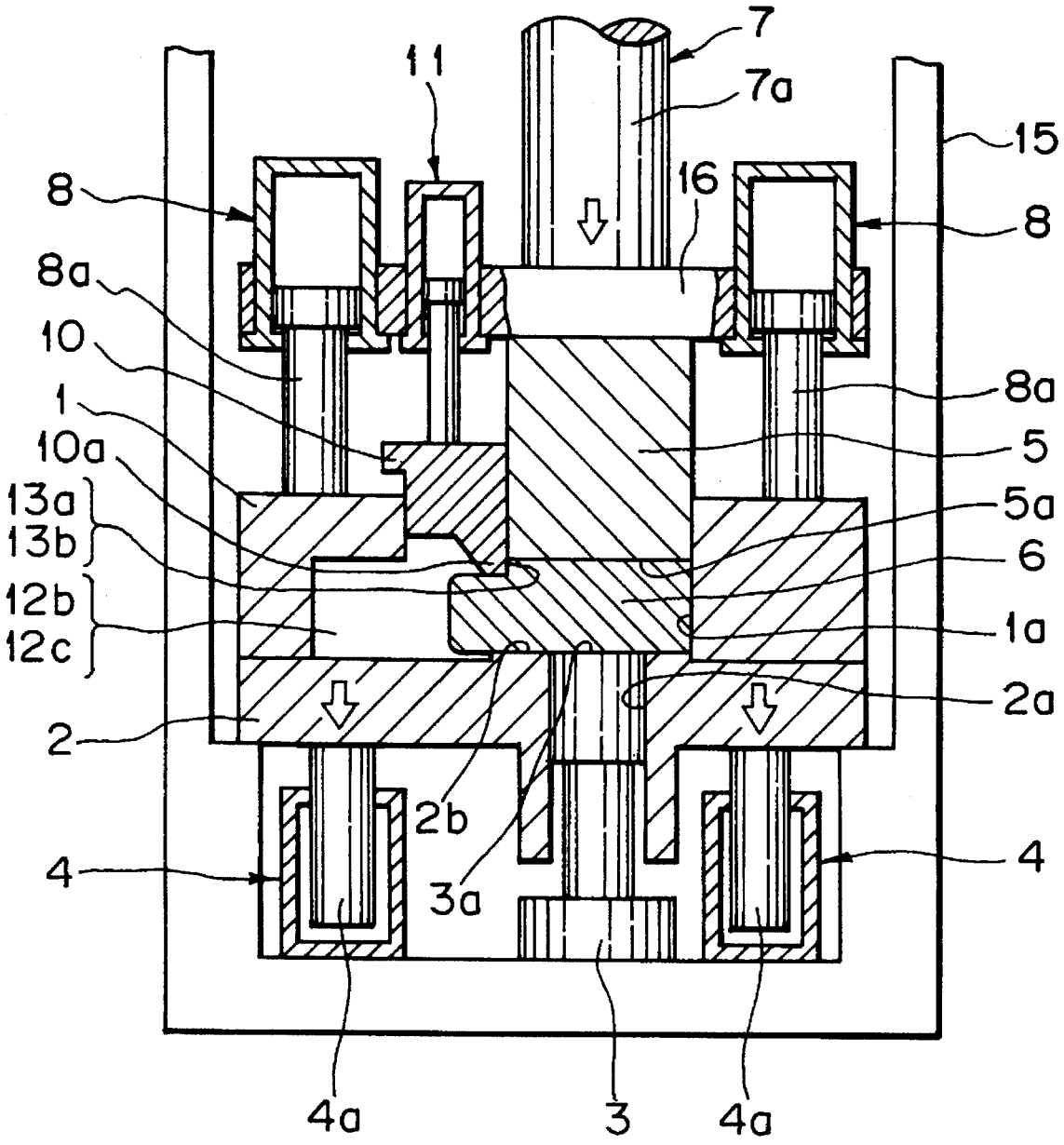
FIGS. 13 through 15 are partial cross-sectional views of an embodiment of the die-lateral extruding apparatus provided with an orifice block, according to the present invention.
Figure 14:
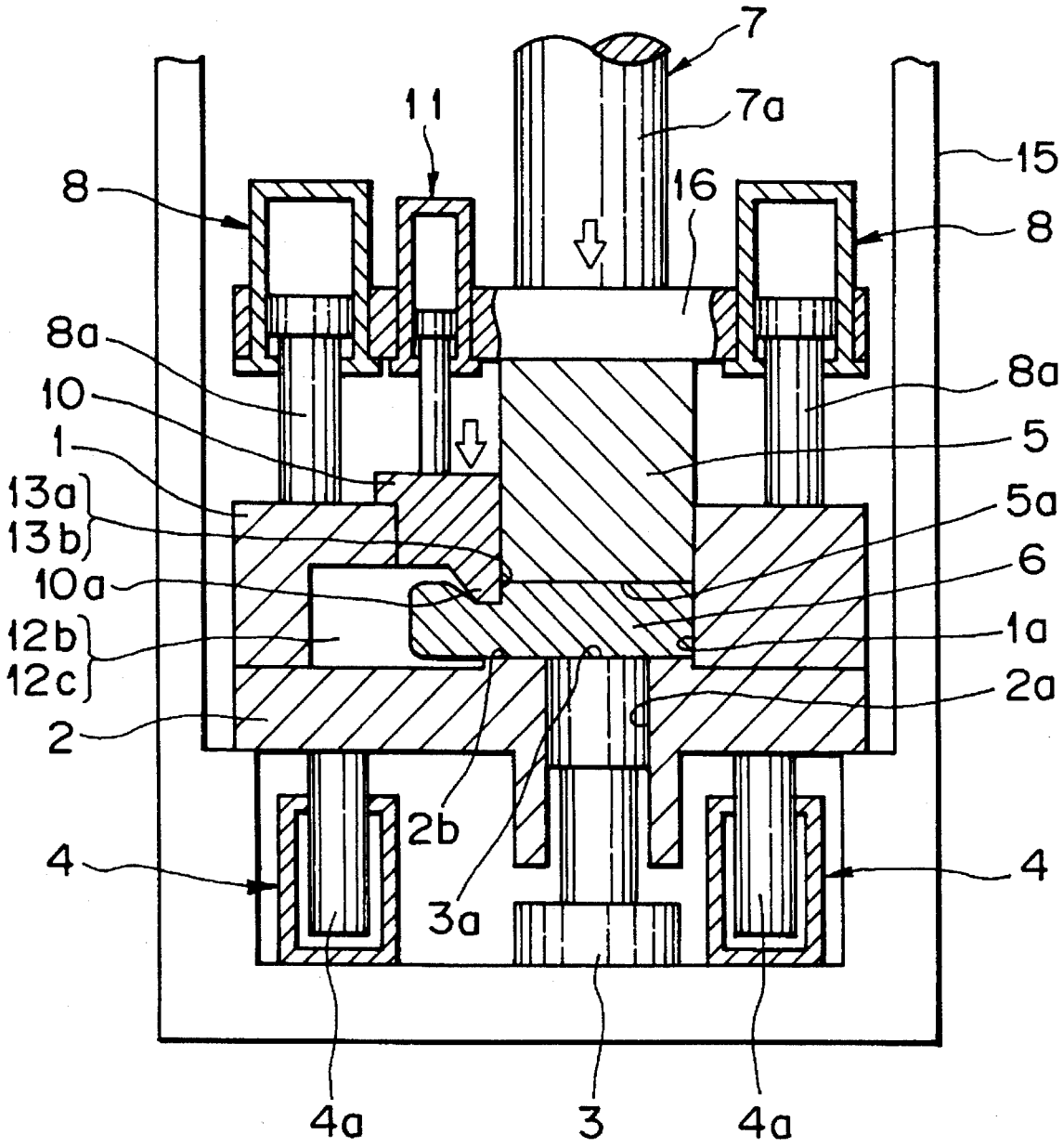
Figure 15:
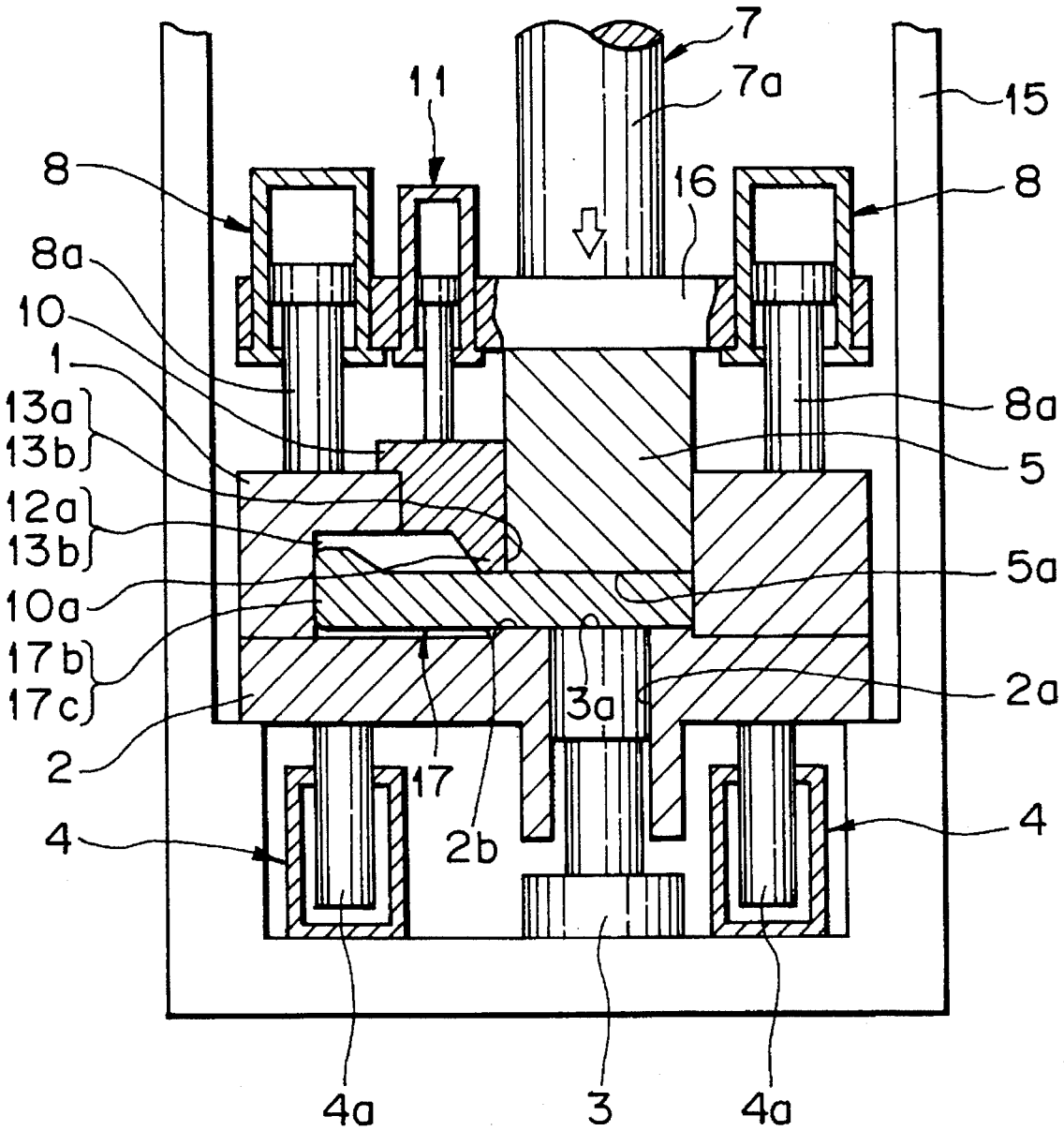

According to another embodiment of the method of the present invention, the orifice(s) may be provided in an orifice block driven by a driving device. Referring to FIGS. 13 through 15, a preferred embodiment of this method is illustrated. The same parts of the apparatus as those shown in FIGS. 1 through 7 are denoted by the same reference numbers. In the die-lateral extruding apparatus shown in these drawings, not the projection 1*b* which is integral with the first die 1, but the orifice block 10, which is movable separate from the first die 1, is provided and has the projection 10*a*. The upper periphery of the orifices 13*a*, 13*b* is contracted by the projection 10*a*. The orifice block 10 is driven by the fourth driving device 11 which is rigidly secured to the supporting member 16 and is hence liftable relative to the first die 1.

The die-lateral extruding apparatus shown in FIGS. 13 through 15 can extrude the metal bar stock through the orifices 13*a*, 13*b* to form the extended portions 17*b*, 17*c* of a shaped article 17. The thickness of the extended portions 17*b*, 17*c* can be varied by the projection 10*a* of the orifice block 10 as described as follows.

A metal bar stock 6 is heated and accommodated in the container 9. The first punch 5 is driven downward to compression-deform the entire metal bar stock by upsetting. The orifice block 10 is lifted somewhat above the first die 1, while the first punch 5 is inserted into the aperture defined by the orifice block 10 and the first die 1. During the primary shaping, the first punch 5 is driven down to such a position that the first stock contact-surface 5*a* of the first punch 5 is sufficiently higher than the projection 1*a*. As is shown in FIG. 13, the projection 10*a* of orifice block 10 contracts the upper periphery of orifices 13*a*, 13*b*. The metal bar stock flowing somewhat through the orifices 13*a*, 13*b* at the end of primary shaping has a somewhat large cross-sectional area. When the primary shaping is completed, the second stock contact-surface 3*a* of the second punch 3 coincides with the third stock contact-surface 2*b* of the second die 2. The second stock contact-surface 3*a* of the second die 2 hence forms a part of the die cavity together with the second die 2.

Referring to FIG. 14, the first driving device 7 is driven to lower the orifice block 10 and the first punch 5 together. The cross section of the orifices 13*a*, 13*b* hence diminishes, and the metal bar stock 6 is pressed by the first punch 5. The extended portions 17*b*, 17*c* of the shaped article 17 are extruded through the orifices 13*a*, 13*b* and has a cross section gradually decreasing in the direction toward the orifices 13*a*, 13*b*. The upper surface of the extended portions is therefore aslant.

Subsequently, while the orifice block 10 is maintained at the position as described above, the first driving device 7 is driven to lower further only the first punch 5 until its first stock contact-surface 5*a* coincides with the projection 10*a* of the orifice block 10. During this extrusion, the orifice block 10 is easily maintained at the position shown in FIG. 14, because a flange of the orifice block 10 rests on the first die 1. In addition, the lateral extruding material is laterally extruded via the orifices 13*a*, 13*b*, whose upper periphery is contracted by the projection 10*a*, while maintaining uniform thickness. An irregularly shaped article 17 is thus shaped as shown in FIG. 15. When the first stock contact-surface 5*a* of the first punch 5 coincides with the projection 10*a* of the orifice block 10, the extension spaces 12*a*, 12*c* of the cavity 12 are substantially filled with the metal bar stock 6. The secondary shaping is thus completed.

After the secondary shaping, the first die 1, the first punch 5 and the orifice block 10 are reverted to the original position. The lower cylinder assemblies 4 are forward driven so as to relieve tight contact between the second stock contact-surface 3*a* of the second punch 3 and the shaped article 17. It can then be withdrawn from the die-lateral extruding apparatus.

Referring to FIGS. 16 through 26, preferred embodiments of said another inventive method and said another inventive apparatus are illustrated.

A portal frame is denoted by the reference number 35. The upper die 21 is vertically driven by the cylinder assemblies 27 which are mounted in the upper portion of the portal frame 35. The lower die 22 is located in the lower portion of the portal frame 35. The peripheral portion of the upper die 21 is tightly in contact with the lower die 22. A cavity 23, which has an irregular cross section other than circular, triangular in the present example, is defined between the upper and lower dies 21 and 22, respectively. An opposed mandrel 25 is inserted into the lower die 22.

A punch 24 is positioned in the upper central portion of the frame 35 and can be vertically driven by cylinder assembly 28. The punch 24 is downward driven by the cylinder assembly 28 and is inserted into the aperture 21*a* formed at the center of the upper die 21. The bottom edge of the aperture 21*a* through the upper die 21 is chamfered to form a smooth surface. A reverting cylinder (not shown in the drawing) can lift the upper die 21 and the punch 24 so as to open the dies.

Meanwhile, the opposed mandrel 25 is vertically driven by a cylinder assembly 30 mounted in the central lower portion of the portal frame 35. The opposed mandrel 25 slides therefore in the aperture 22*a* formed through the lower die 22 at its center. The opposed mandrel 25 is lifted to a predetermined position by the cylinder assembly 30. The opposed mandrel 25 has a greater surface area than the punch 24 and the aperture 21*a* of the upper die 21.

Figure 16:
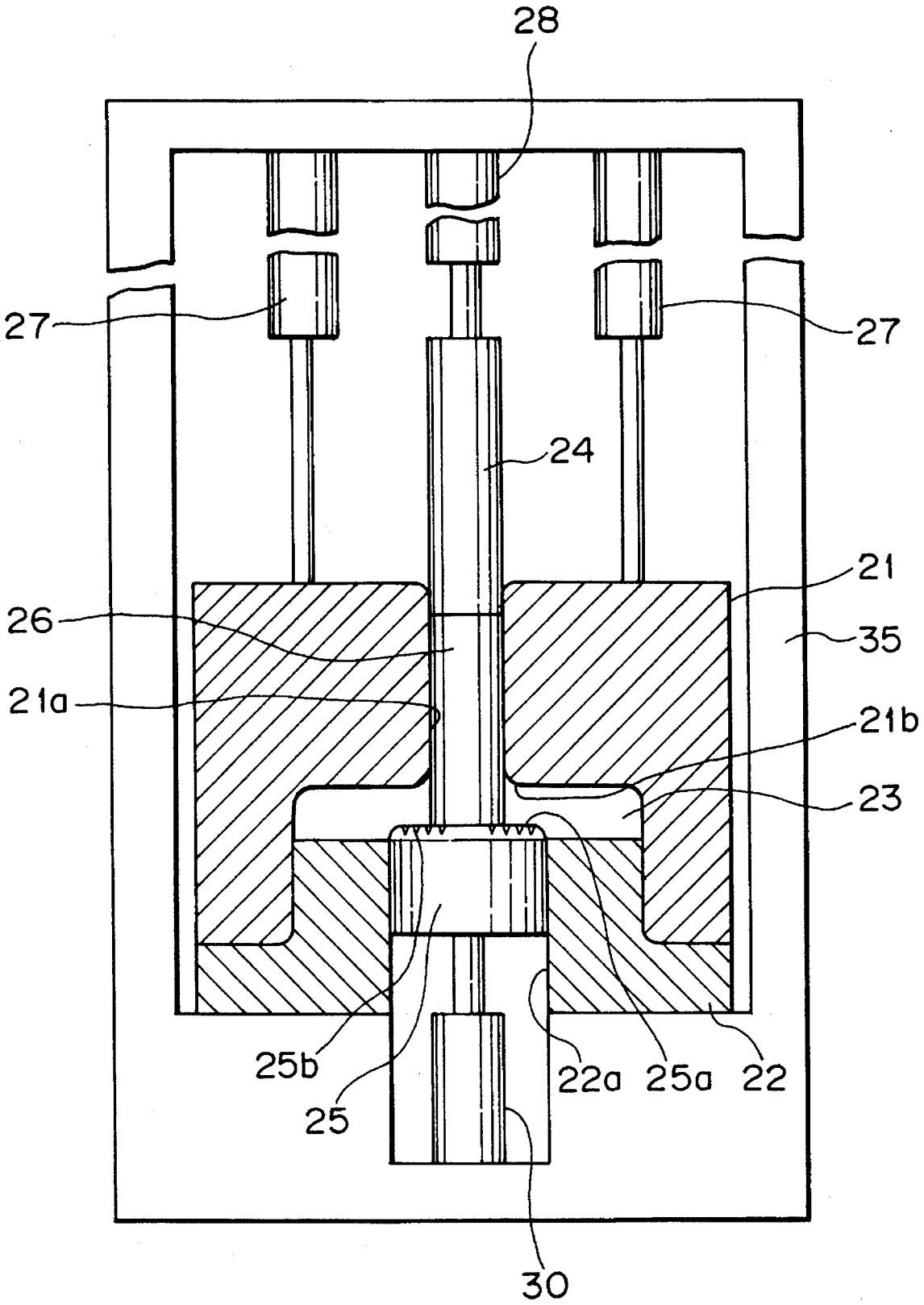
FIG. 16 is a front cross-sectional view of the second mentioned inventive die-lateral extruding apparatus.
Figure 17:
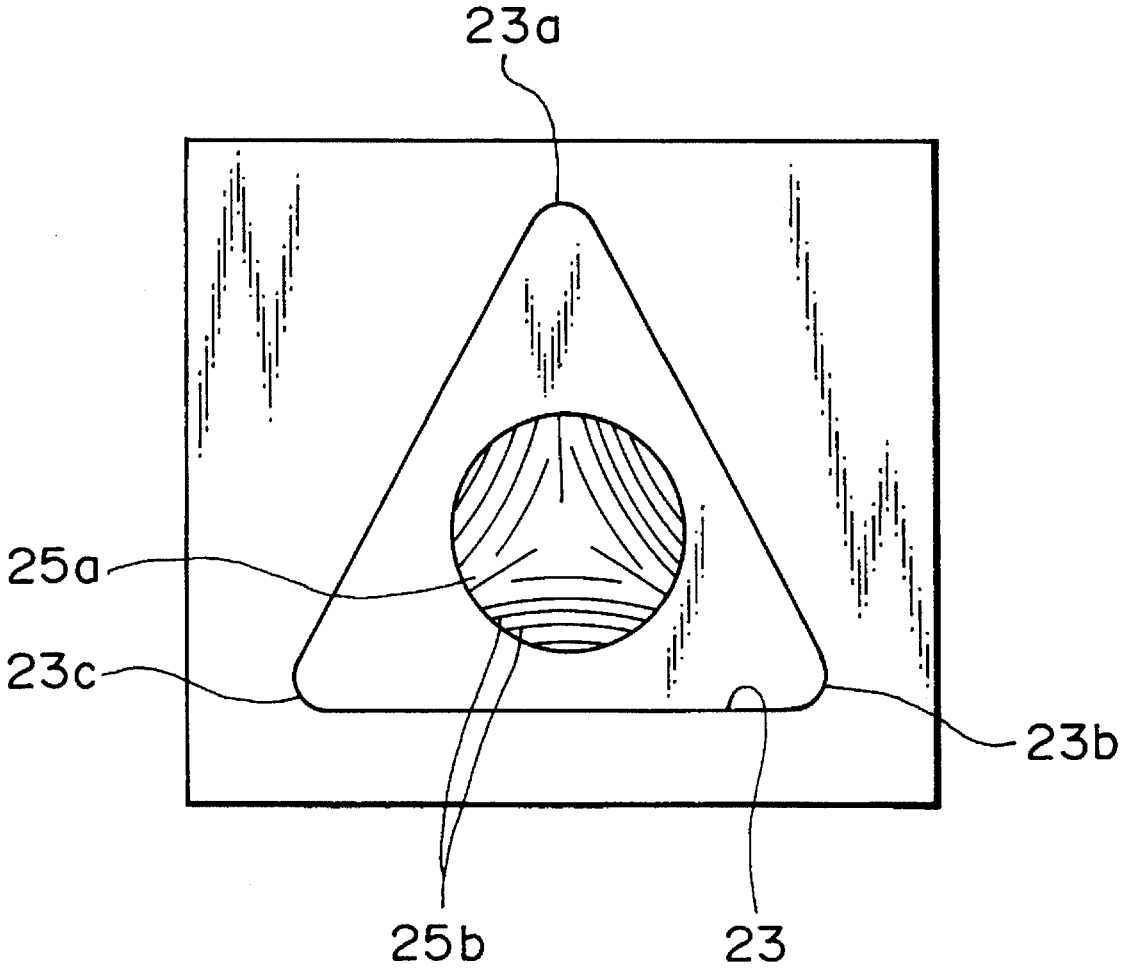
FIG. 17 is a plan view showing the lower die and the opposed mandrel.
Figure 25:
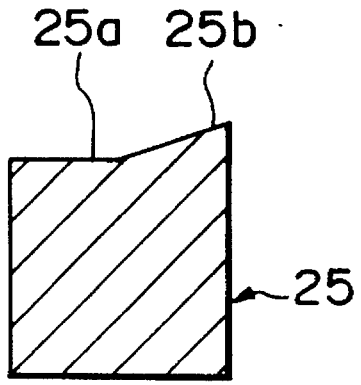
FIG. 25 shows the stock contact surface of another opposed mandrel.

The stock contact-surface of the opposed mandrel 25 is denoted by the reference number 25*a* and defines a portion of the cavity 23 when the opposed mandrel 25 is lifted up to the position shown in FIG. 16. The punch 24 compresses the metal bar stock 6 in the central axial direction. The metal bar stock 6 then flows laterally, while it is subjected to frictional force and guided by the guide portions 25*b* in a predetermined direction. The guide portions 25*b* adjust the friction force of the metal bar stock and promotes the flow of metal bar stock 6 directed toward a recess of the cavity 23. The guide portions 23 are, for example, grooves extending toward the apexes 23*a*, 23*b* and 23*c* of a triangle cavity (FIG. 17). The guide portions are for example aslant potions 25*b* as shown in FIG. 25.

A method for producing a preliminarily shaped article using the apparatus as shown in FIG. 16 is now described. The cavity 23 is first defined by means of driving the cylinder assemblies 27 and hence bringing the upper and lower dies 21 and 22, respectively, into tight contact with one another to form a cavity 23. Heated cylindrical metal bar stock 6 is inserted into the aperture 21*a* of the upper die 21. Meanwhile, the opposed mandrel 25 is protruded slightly into the cavity 23 and is held at a position slightly above the lower die 22.

Figure 18:
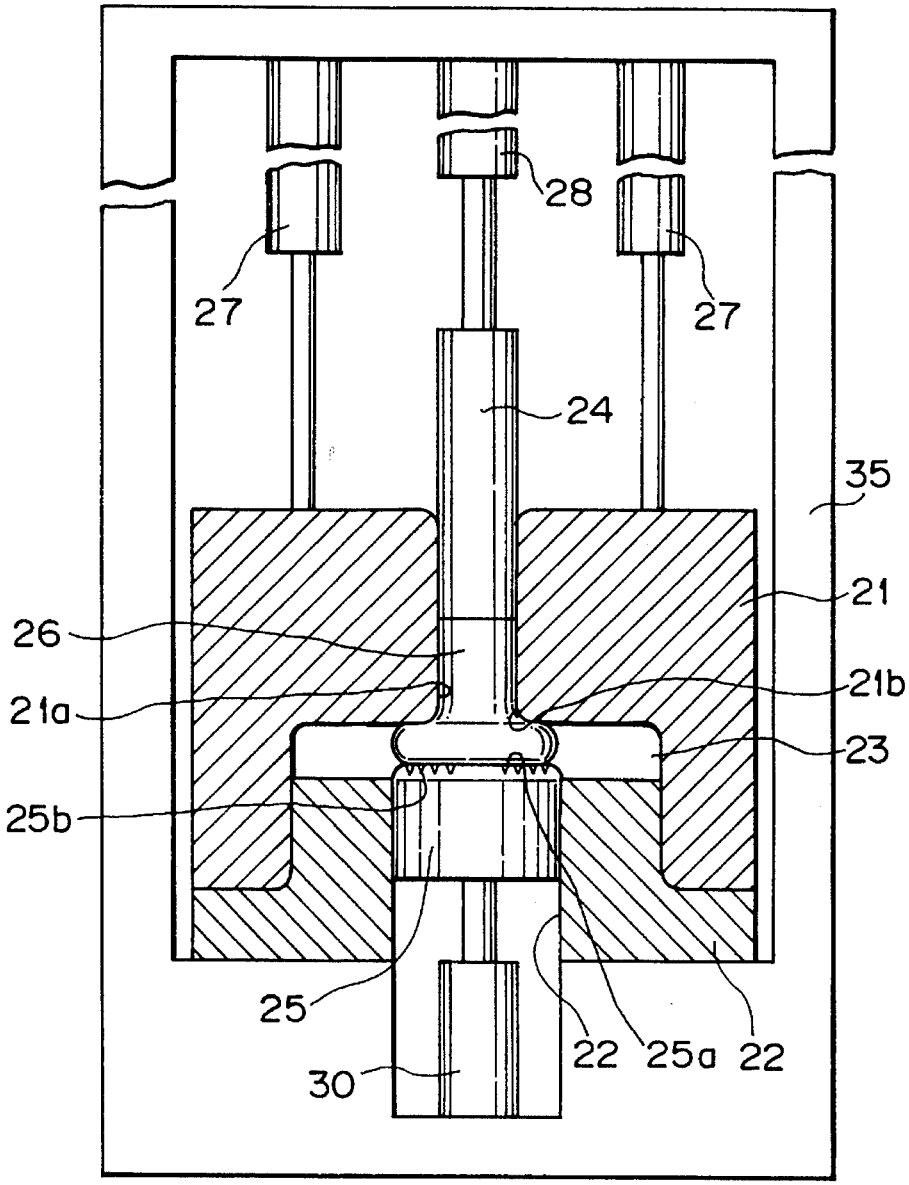
FIG. 18 shows the operation of the apparatus shown in FIG. 16.

Referring to FIG. 18, the punch 24 is lowered by the cylinder assembly 28. As a result, the metal bar stock 6, which is inserted in the aperture 21*a* of the upper die 21, is upsetted between the punch 24 and the opposed mandrel 25. The punch 24 is further lowered to compress the metal bar stock 6, which is then extruded laterally through the clearance formed between the opposed mandrel 25 and the upper die 21 and diffuses into the cavity 23.

Figure 19:
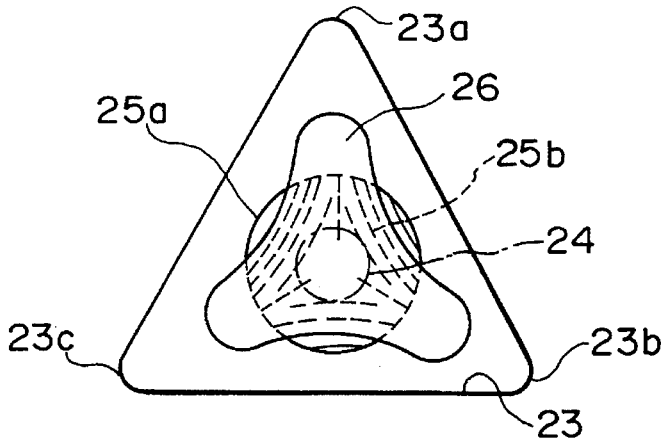
FIG. 19 shows flow of the metal bar stock.

Referring to FIG. 19, the guide portions 25*b* formed on the stock contact-surface 25*a* of the opposed mandrel impedes the flow of material toward each side of the triangle cavity 23. Under resistance against flow toward the sides of triangle cavity 23, the flow of the metal bar stock is preferentially directed to the apexes 23*a*, 23*b*, and 23*c*. The metal flow is therefore divided into partial flows. A portion of the metal bar stock leaves the stock contact-surface 25*a* of the opposed mandrel 25 and is extruded laterally. Since the opposed mandrel 25 slightly protrudes into the cavity 23, the laterally extruded metal bar stock is brought into slight contact with the upper and lower dies 21, 22 and the flow of metal is free. Friction resistance between the metal bar stock 26 and the upper and lower dies 21, 22 is therefore lessened. The surfaces of the upper and lower dies 1, 2 defining the cavity 23 support, from above and beneath, the metal bar stock 26 diffusing in the cavity 23 and prevent the metal bar stock 26 from deflecting and sagging.

Figure 20:
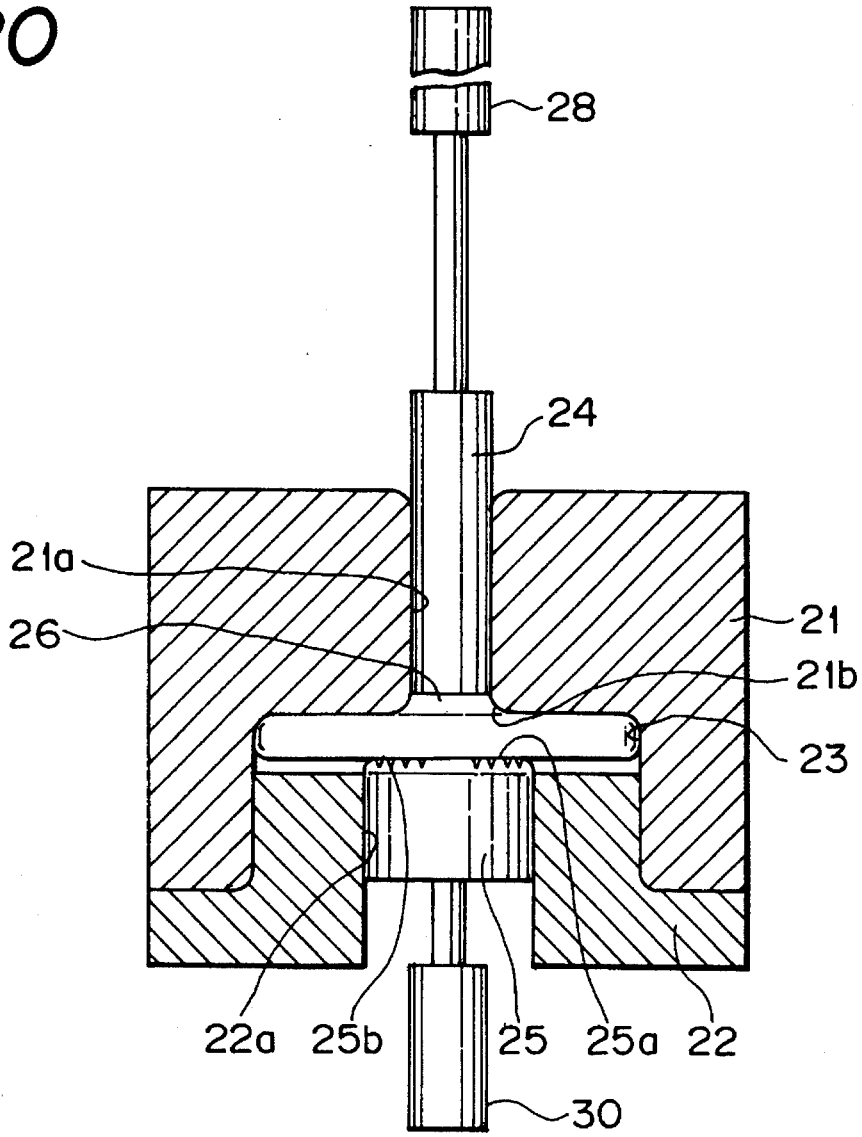
FIG. 20 shows the operation of the apparatus shown in FIG. 16.
Figure 21:
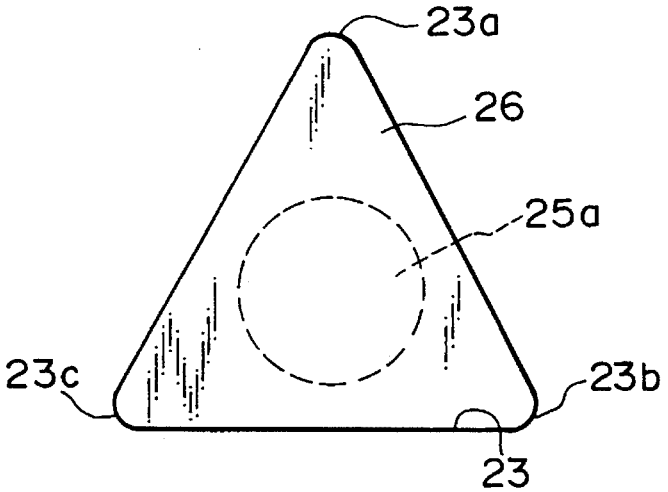
FIG. 21 shows flow of the metal bar stock.

Referring to FIGS. 20 and 21, the punch 24 is further lowered to compress laterally the metal bar stock 26 in the cavity 23. The shape of guide portions 25*b* can be so adjusted that the metal bar stock 26 arrives virtually simultaneously at the apexes 23*a*, 23*b*, 23*c* of the triangle cavity 23. Meanwhile, the metal flow toward the sides of the triangle is suppressed by the guide portions 25*b*. Since this flow is more free as compared with the case of the closed-die forging, the constraining force between the upper and lower dies 21, 22 is considerably lessened. The press force of the cylinder assembly 28, which creates the shaping load of the punch 24, is therefore relatively small. After the shaping, the upper die 21 and the punch 24 are lifted by the reverting cylinder assembly (not shown). The shaped article can then be taken out of the metal dies.

In the shaping as described above, since the opposed mandrel 25 is not displaced vertically by the cylinder assembly 30, the opposed mandrel 25 can be constructed as an integral member of the lower die 22.

Subsequent to the shaping as described with reference to FIGS. 16 through 21, the preliminarily shaped article is subjected to the final shaping, in which portions of such article is reshaped. It is possible to carry out this shaping by a one-heat hot-forging process.

Figure 22:
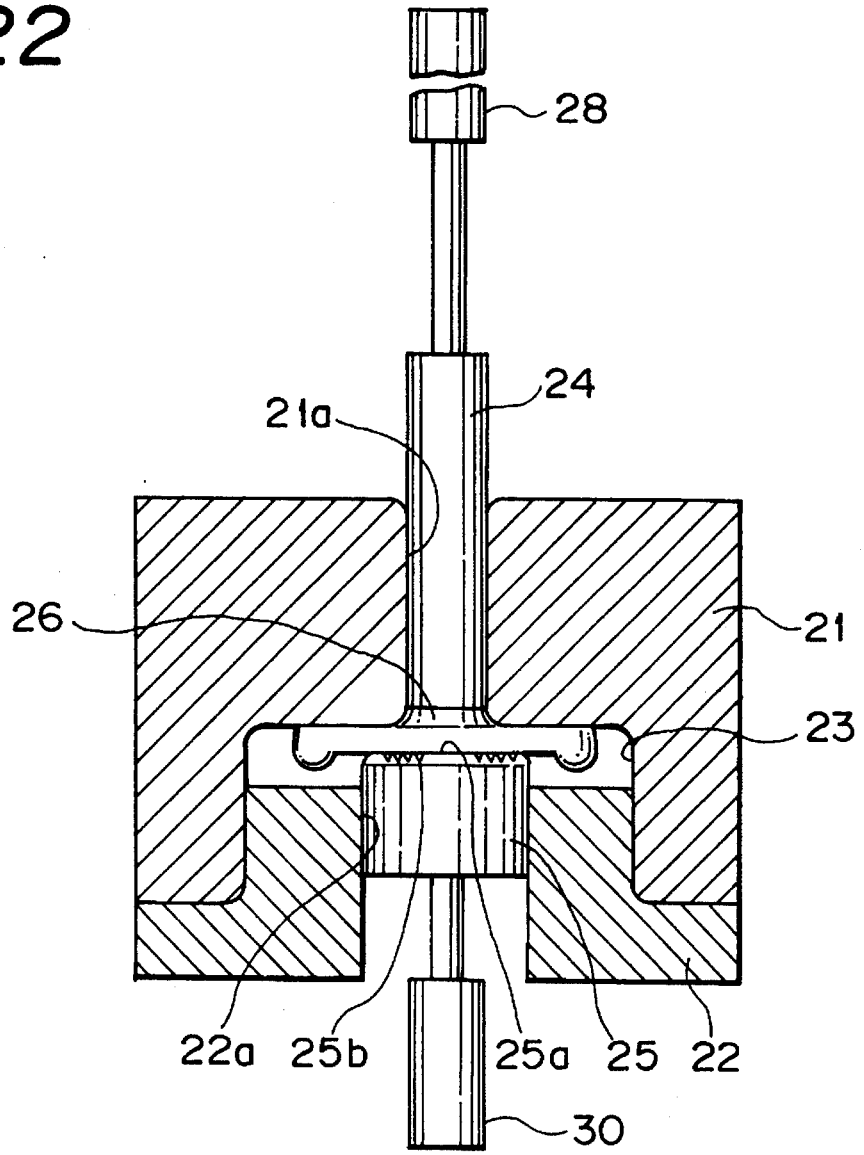
FIG. 22 shows the operation of the apparatus shown in FIG. 16.
Figure 23:
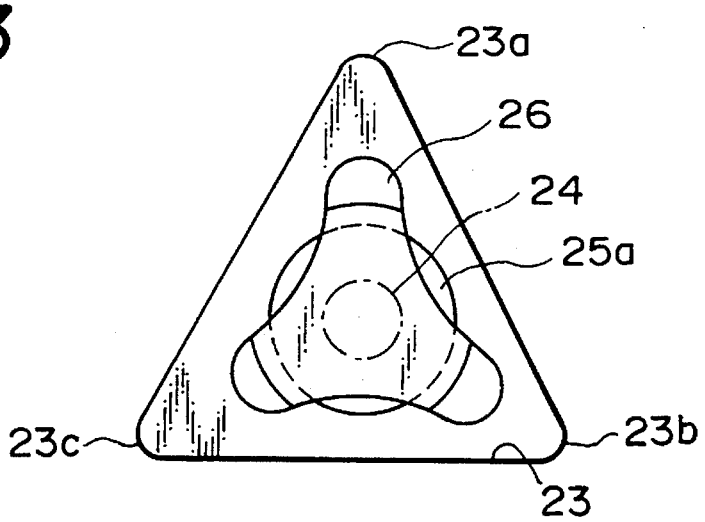
FIG. 23 shows flow of the metal bar stock.

Referring to FIGS. 22 and 23, another structure than that shown in FIGS. 20 and 21 are illustrated. In this structure, the distance between the opposed mandrel 25 and the upper die 21 is controlled during the preliminary shaping so as to adjust the laterally extruded thickness and hence the distribution of volume in the lateral extruding direction. That is, during the preliminary shaping, the cylinder assembly 30 is driven to lift the opposed mandrel 25 so as to appropriately decrease the distance between the opposed mandrel 25 and the upper die 21. Thickness of the material laterally extruded out of this distance subsequently decreases, so that the volume distribution imparted is suitable for the axially non-symmetrical shape of a product.

Figure 24:
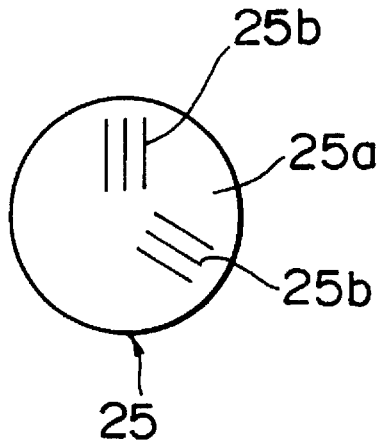
FIG. 24 shows the stock contact surface of another opposed mandrel.
Figure 26:
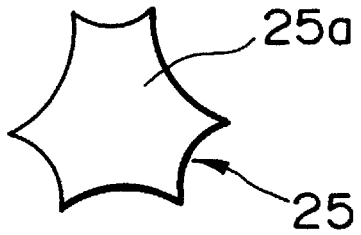
FIG. 26 shows the stock contact surface of another opposed mandrel.

Referring to FIG. 24, an example of the guide portions 25*b* is illustrated. The guide portions 25*b* create two preferential radial metal-flows having 120° angle. Referring to FIG. 26, the shape of stock contact-surface of the opposed mandrel 25 is so adjusted to form an axially non-symmetrical article, i.e., a preliminarily shaped article. It is therefore apparent that not only triangle shape but also other various shapes can be formed by the method of the present invention.

The methods as described with reference to FIGS. 16 through 26 have the following advantages. (1) The shape of the preliminarily shaped article is well suited for the final product. The recovery of material is therefore enhanced. (2) The flow of material is controlled, during the shaping, by a method which is fundamentally different from that of the conventional closed forging. The necessary shaping load is therefore low. (3) Vertical driving devices can be of a small capacity. The investment cost can therefore be saved. (4) These effects (1)–(3) are particularly outstanding in such metal and alloy as aluminum and aluminum alloys which have good hot flowability.

Advantageously, the guide portions described above can be formed on the first punch 5 shown in FIGS. 1, and 4 through 16.

We claim:

1. A method for lateral-die extruding, wherein a metal bar stock is prepared, and said metal bar stock is lateral-die forged into an irregularly shaped article having a base portion and at least one extended portion extending from said base portion to an axially non-symmetrical pattern, said method comprising the steps of:

accommodating said metal bar stock into a container of a lateral-die extruding machine, which comprises:

a first punch having a first contact surface with the metal bar stock, having substantially the same flat-shape as the shape of said base portion of the irregularly shaped article, a first die having an aperture therethrough, a second die having an aperture therethrough, a second punch slidably fitted in the aperture of the second die and having a second contact surface with the metal bar stock, and the container for accommodating the metal bar stock defined by the second contact surface with the metal bar stock and the aperture of the second die;

bringing the metal bar stock into contact with the second contact surface of the second punch;

axially aligning the first and second contact surfaces with the metal bar stock in a vertical direction;

defining a cavity by tightly contacting the first die and the second die;

compressing the metal bar stock by the first punch and the second punch and substantially filling a base space with the metal bar stock thereby completing a primary shaping, wherein said base space is defined by (a) the first contact surface of the metal bar stock at a position where the primary shaping is completed, (b) an inner surface of the first die except for an extension space, and (c) the second contact surface with the metal bar stock and a surface of the second die neighboring said second contact surface, the total of said surfaces (c) being substantially the same as the first contact surface with the metal bar stock, and the surfaces (a), (b) and (c) forming upper, lateral and lower surfaces of said base space, respectively;

coinciding a height of the second contact surface with the metal bar stock of the second punch with a contact surface of the second die with the metal bar stock; and carrying out compression by the first punch while keeping said coinciding height, thereby extruding a portion of the metal bar stock into at least one of said extension space, which is formed in the first die, has shape and dimension substantially the same as those of said at least one extended portion of the shaped article, is laterally communicated with a base portion via an orifice, and has a cross-section greater than the orifice, thereby extruding the metal bar stock and completing a secondary shaping.

2. A method for lateral-die extruding according to claim 1, wherein the first die has, at its portion defining the orifice, a downward projection, and said method comprises, in a secondary shaping, stopping the front end of the first punch at the upper periphery of the orifice.

3. A method for lateral-die extruding according to claim 1, wherein the first die has, at its portion defining the orifice, a downward projection, and said method comprises, in the secondary shaping, lowering the front end of the first punch lower than the upper periphery of the orifice.

4. A method for lateral-die extruding according to claim 1, wherein said orifice is provided in an orifice block driven by a driving device.

5. A method for lateral-die extruding according to claim 1, wherein during said secondary shaping the metal bar stock is guided along guide portions formed on the first contact surface of the first punch.

6. A method for lateral-die extruding according to claim 1, 2, 3, 4 or 5, wherein the metal bar stock has a cross-sectional area between 4 and 25 times that after a primary shaping.

7. A method for lateral-die extruding according to claim 1, 2, 3, 4 or 5, wherein at least one extension portion has a cross section 1.05–1.5 times that of the orifice.

8. A method for lateral-die extruding according to claim 1, 2, 3, 4 or 5, wherein the base portion has a form in the shape of one of a triangle, a quadrangle and a bottle gourd.

9. A method for lateral-die extruding according to claim 8, wherein the second contact surface with metal bar stock has a circular shape.

10. A method for lateral-die extruding according to claim 1, 2, 3, 4 or 5, wherein the orifice is defined by an aperture of the first die and second die, said method comprises virtually coinciding the lower surface of the first punch with an upper periphery of the orifice at the completion of the primary shaping.

11. A method for lateral-die extruding according to claim 1, 2, 3, 4 or 5, wherein a total upsetting ratio of said primary shaping and secondary shaping is between 20% and 75%.

12. A method for lateral-die extruding according to claim 11, wherein compression pressure in the primary shaping is such an extent that the metal bar stock protrudes through the orifice 4 mm at the most.

13. A method for lateral-die extruding according to claim 11, wherein the metal bar stock consists of aluminum or aluminum-alloy.

14. A method for lateral-die extruding according to claim 1, 2, 3, 4 or 5, comprising, before accommodating the metal bar stock into the container, heating the metal bar stock to a plastic-working temperature, and not carrying out reheating until the completion of the secondary shaping.

15. A method for lateral-die extruding, which includes:

preparing a metal bar stock, which may have various cross-sectional shapes; and, lateral-die extruding the metal bar stock into an irregularly shaped article, said method further comprising the steps of:

inserting the metal bar stock into an aperture of a die-press machine, which comprises an upper die having an aperture therethrough, a lower die having an aperture therethrough and arranged opposite to the upper die at a predetermined distance, an opposed mandrel having a stock-contact surface with the metal bar stock, said surface being greater than the aperture of the upper metal die, a punch inserted into the aperture from above the metal bar stock, having a stock contact-surface and vertically driven by a first driving device, and, a guide portion for guiding laterally the flow of the metal bar stock being compressed by the punch, formed on the contact surface of the opposed mandrel, compressing between the stock contact surfaces of the punch and the opposed mandrel, the metal bar stock inserted in the aperture;

during the compressing, flowing the metal bar stock laterally from between the stock contact surfaces of the upper metal die and the opposed mandrel, thereby shaping an irregularly shaped article.

16. A method for die forging according to claim 15, wherein the die-press machine further comprises a second driving device for vertically driving the opposed mandrel, on whose stock-contact surface the guide portion is formed, and said method further comprises vertically displacing the opposed mandrel, thereby varying the thickness of the article being irregularly shaped.

17. A lateral-die extruding apparatus for die-forming a metal bar stock into an irregularly shaped article having a base portion and at least one extended portion extending from the base portion in an axially non-symmetrical form, said apparatus comprising:

a first punch having a first contact surface with the metal bar stock, which surface having substantially the same flat shape with the base portion of the article;

a first driving device for driving the first punch;

a first die having an aperture therethrough;

a second driving device for driving a second punch;

a second die having an aperture therethrough;

a third driving device for driving the second die;

a second punch slidably fitted in the aperture of the second die and having a second contact surface with the metal bar stock; and a container for accommodating the metal bar stock and defined by the second stock contact surface of the second punch and the aperture of the second die, wherein (a) the first contact surface of metal bar stock at a position where a primary shaping is completed, (b) an inner surface of the first die except for an extension space, and (c) the second contact surface of metal bar stock and a second die-neighboring surface define a base space, the total of said surfaces (c) being substantially the same as the first contact surface with the metal bar stock, and the surfaces (a), (b) and (c) forming upper, lateral and lower surfaces of said base space, respective, wherein said second die-neighboring surface is a surface of the second die neighboring said second contact surface; and at least one extension space laterally communicated with the base space through an orifice and having a cross-section greater than that of the orifice.

18. A lateral-die extruding apparatus according to claim 17, wherein said orifice is provided in a movable orifice block having a downward projection, said apparatus further comprising a fourth driving device for driving the orifice block and varying the cross sectional area of the orifice.

19. A lateral-die extruding apparatus according to claim 17 or 18, wherein said first punch has on the first stock contact surface a guide portion for laterally guiding the flow of the metal bar stock.

20. A lateral-die extruding apparatus according to claim 17 or 18, wherein the second die-neighboring surface of the second die is higher than the other surface of the second die.

21. A lateral-die extruding apparatus according to claim 17 or 18, wherein said first die has, in its portion defining said orifice, a downward projection.

22. A lateral-die extruding apparatus, comprising:

an upper die having an aperture therethrough, for inserting a metal bar stock which may have various cross-sectional shapes;

a punch inserted into the aperture of the upper die;

a first driving apparatus for vertically driving the punch;

an opposed mandrel having a contact surface with the metal bar stock, said surface being greater than the aperture of the upper metal die;

another punch inserted into the aperture from above the metal bar stock and vertically driven by the first driving device;

a guide portion for guiding laterally the flow of the metal bar stock being compressed by the punch, formed on the contact surface of the opposed mandrel; and a second driving device for vertically driving the opposed mandrel, wherein the opposed mandrel is inserted into an aperture through a lower die, the lower die being in tight contact with a peripheral portion of the upper die and forms a cavity between a non-contact portion of the lower die and the upper die.

* * * * *